US010877387B2

(12) United States Patent
Fukudome et al.

(10) Patent No.: US 10,877,387 B2
(45) Date of Patent: Dec. 29, 2020

(54) MAGNETIC TONER

(71) Applicant: CANON KABUSHIKI KAISHA, Tokyo (JP)

(72) Inventors: Kosuke Fukudome, Tokyo (JP); Tetsuya Kinumatsu, Mishima (JP); Yusuke Hasegawa, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/583,945

(22) Filed: Sep. 26, 2019

(65) Prior Publication Data

US 2020/0103774 A1 Apr. 2, 2020

(30) Foreign Application Priority Data

Oct. 2, 2018 (JP) ..... 2018-187627

(51) Int. Cl.
*G03G 9/08* (2006.01)
*G03G 9/083* (2006.01)
*G03G 9/087* (2006.01)

(52) U.S. Cl.
CPC ..... *G03G 9/0835* (2013.01); *G03G 9/0821* (2013.01); *G03G 9/0832* (2013.01); *G03G 9/0833* (2013.01); *G03G 9/0836* (2013.01); *G03G 9/0837* (2013.01); *G03G 9/0838* (2013.01); *G03G 9/08755* (2013.01)

(58) Field of Classification Search
CPC ..... G03G 9/08755; G03G 9/0835; G03G 9/0836; G03G 9/0821
USPC ..... 430/109.4, 111.4
See application file for complete search history.

(56) References Cited

U.S. PATENT DOCUMENTS

| | | | |
|---|---|---|---|
| 6,586,151 | B1 | 7/2003 | Naka et al. |
| 6,703,176 | B2 | 3/2004 | Naka et al. |
| 6,803,164 | B2 | 10/2004 | Mizoo et al. |
| 6,953,646 | B2 | 10/2005 | Doujo et al. |
| 7,123,862 | B2 | 10/2006 | Hasegawa et al. |
| 7,160,660 | B2 | 1/2007 | Dojo et al. |
| 7,368,211 | B2 | 5/2008 | Hasegawa et al. |
| 7,470,494 | B2 | 12/2008 | Nishiyama et al. |
| 7,582,401 | B2 | 9/2009 | Ogawa et al. |
| 7,704,659 | B2 | 4/2010 | Ogawa et al. |

(Continued)

FOREIGN PATENT DOCUMENTS

| | | |
|---|---|---|
| JP | 2005-172886 | 6/2005 |
| JP | 2012-093752 | 5/2012 |

(Continued)

OTHER PUBLICATIONS

U.S. Appl. No. 16/584,346, Tetsuya Kinumatsu, filed Sep. 26, 2019.

(Continued)

*Primary Examiner* — Mark A Chapman
(74) *Attorney, Agent, or Firm* — Venable LLP

(57) ABSTRACT

A magnetic toner comprising a magnetic toner particle including a binder resin, a magnetic body and a crystalline polyester, wherein a storage elastic modulus E'(40) [Pa] at 40° C. and a storage elastic modulus E'(85) [Pa] at 85° C., which are obtained in a powder dynamic viscoelasticity measurement of the magnetic toner, satisfy the following formulas (1) to (3).

$$E'(40) \geq 6.0 \times 10^9 \quad (1)$$

$$E'(85) \leq 5.5 \times 10^9 \quad (2)$$

$$[E'(40) - E'(85)] \times 100 / E'(40) \geq 40 \quad (3)$$

9 Claims, 2 Drawing Sheets

(56) References Cited

U.S. PATENT DOCUMENTS

| | | | |
|---|---|---|---|
| 7,678,524 | B2 | 5/2010 | Hasegawa et al. |
| 7,811,734 | B2 | 10/2010 | Ogawa et al. |
| 7,939,231 | B2 | 5/2011 | Ogawa et al. |
| 8,084,174 | B2 | 12/2011 | Hasegawa et al. |
| 8,124,306 | B2 | 2/2012 | Hirata et al. |
| 8,492,064 | B2 | 7/2013 | Jungle et al. |
| 8,603,712 | B2 | 12/2013 | Aoki et al. |
| 8,614,044 | B2 | 12/2013 | Matsui et al. |
| 8,741,519 | B2 | 6/2014 | Watanabe et al. |
| 8,846,284 | B2 | 9/2014 | Kinumatsu et al. |
| 8,918,035 | B2 | 12/2014 | Hasegawa et al. |
| 9,029,055 | B2 | 5/2015 | Aoki et al. |
| 9,034,549 | B2 | 5/2015 | Shiotari et al. |
| 9,040,216 | B2 | 5/2015 | Fukudome et al. |
| 9,097,997 | B2 | 8/2015 | Nomura et al. |
| 9,116,448 | B2 | 8/2015 | Terauchi et al. |
| 9,134,637 | B2 | 9/2015 | Hotta et al. |
| 9,141,012 | B2 | 9/2015 | Moribe et al. |
| 9,152,065 | B2 | 10/2015 | Sano et al. |
| 9,213,250 | B2 | 12/2015 | Nomura et al. |
| 9,213,251 | B2 | 12/2015 | Ohmori et al. |
| 9,217,943 | B2 | 12/2015 | Matsui et al. |
| 9,235,151 | B2 | 1/2016 | Tanaka et al. |
| 9,239,528 | B2 | 1/2016 | Hasegawa et al. |
| 9,244,371 | B2 | 1/2016 | Suzumura et al. |
| 9,261,806 | B2 | 2/2016 | Moribe et al. |
| 9,285,697 | B2 | 3/2016 | Fukudome et al. |
| 9,309,349 | B2 | 4/2016 | Watanabe et al. |
| 9,429,860 | B2 | 8/2016 | Kinumatsu et al. |
| 9,454,096 | B2 | 9/2016 | Hasegawa et al. |
| 9,470,993 | B2 | 10/2016 | Nishikawa et al. |
| 9,594,323 | B2 | 3/2017 | Fujikawa et al. |
| 9,606,462 | B2 | 3/2017 | Nomura et al. |
| 9,625,841 | B2 | 4/2017 | Hiroko et al. |
| 9,625,842 | B2 | 4/2017 | Uratani et al. |
| 9,625,844 | B2 | 4/2017 | Kaya et al. |
| 9,658,548 | B2 | 5/2017 | Magome et al. |
| 9,658,554 | B2 | 5/2017 | Kinumatsu et al. |
| 9,798,256 | B2 | 10/2017 | Kosaki et al. |
| 9,798,262 | B2 | 10/2017 | Toyoizumi et al. |
| 9,804,514 | B2 | 10/2017 | Suzumura et al. |
| 9,804,519 | B2 | 10/2017 | Suzumura et al. |
| 9,811,016 | B2 | 11/2017 | Aoki et al. |
| 9,823,595 | B2 | 11/2017 | Toyoizumi et al. |
| 9,841,692 | B2 | 12/2017 | Hasegawa et al. |
| 9,857,713 | B2 | 1/2018 | Kosaki et al. |
| 9,869,943 | B2 | 1/2018 | Aoki et al. |
| 9,927,728 | B2 | 3/2018 | Arimura et al. |
| 9,946,179 | B2 | 4/2018 | Arimura et al. |
| 9,946,181 | B2 | 4/2018 | Hasegawa et al. |
| 9,964,874 | B2 | 5/2018 | Suzumura et al. |
| 9,964,881 | B2 | 5/2018 | Ikejiri et al. |
| 9,971,262 | B2 | 5/2018 | Hasegawa et al. |
| 9,971,263 | B2 | 5/2018 | Fukudome et al. |
| 9,971,264 | B2 | 5/2018 | Sano et al. |
| 10,012,923 | B2 | 7/2018 | Sano et al. |
| 10,101,683 | B2 | 10/2018 | Nishikawa et al. |
| 10,197,934 | B2 | 2/2019 | Matsui et al. |
| 10,289,016 | B2 | 5/2019 | Fukudome et al. |
| 10,295,921 | B2 | 5/2019 | Ohmori et al. |
| 10,310,397 | B2 | 6/2019 | Sano et al. |
| 10,409,180 | B2 | 9/2019 | Koji et al. |
| 10,545,420 | B2 | 1/2020 | Kinumatsu et al. |
| 2015/0378272 | A1 | 12/2015 | Hase et al. |
| 2016/0378003 | A1 | 12/2016 | Arimura et al. |
| 2018/0173126 | A1 | 6/2018 | Ohmori et al. |
| 2019/0155181 | A1 | 5/2019 | Nagashima et al. |
| 2019/0346794 | A1* | 11/2019 | Sudo ..... G03G 15/2057 |

FOREIGN PATENT DOCUMENTS

| | | |
|---|---|---|
| JP | 2013-137420 | 7/2013 |
| JP | 2015-148668 | 8/2015 |

OTHER PUBLICATIONS

U.S. Appl. No. 16/701,260, Koji Nishikawa, filed Dec. 3, 2019.
U.S. Appl. No. 16/701,292, Tetsuya Kinumatsu, filed Dec. 3, 2019.
U.S. Appl. No. 16/701,412, Kosuke Fukudome, filed Dec. 3, 2019.

* cited by examiner

MAGNETIC TONER

BACKGROUND OF THE INVENTION

Field of the Invention

The present invention relates to a magnetic toner suitable for a recording method using electrophotography, electrostatic recording, and toner jet recording.

Description of the Related Art

In recent years, there has been a demand for means capable of stably outputting images in various environments in a wide range of fields from office to home, and in all of these situations, it is required that the output image has high image quality.

Further, demands relating to the image output apparatus itself are exemplified by energy saving, downsizing, and increasing the printing speed.

Regarding energy saving, toners that can be sufficiently fixed to paper at lower temperatures are required. As a means for improving the fixability, it has been considered to control the melting characteristics of the toner by incorporating a crystalline polyester which promotes melt deformation in the toner particle.

A crystalline polyester having a high effect on low-temperature fixability has the property of being easily compatible with the binder resin in the vicinity of the melting point, and promotes rapid melt deformation of the toner at the time of fixing.

Therefore, Japanese Patent Application Publication No. 2013-137420 and Japanese Patent Application Publication No. 2012-93752 disclose the possibility of improving low-temperature fixability of the toner by using a crystalline polyester.

Meanwhile, miniaturization of a cartridge accommodating a developer is an effective means for reducing the image output apparatus in size. In this respect, a one-component development system is preferable to a two-component development system using a carrier, and a contact development system is preferable in order to obtain a high-quality image at the same time. Therefore, the one-component contact development system is an effective means for achieving the miniaturization and high image quality.

The one-component contact development system is a development system in which the toner bearing member and the electrostatic latent image bearing member are in contact arrangement (arranged in contact with each other). That is, since these bearing members carry the toner by rotation, and a strong shear force is applied to the contact portion, the toner needs to have high durability in order to obtain a high-quality image until the latter half of the life of the cartridge.

Further, in the one-component contact development system, frictional heat is likely to be generated when the toner receives shear at the contact portion, so the toner is subjected to shear in a state of being locally exposed to high temperature.

Furthermore, due to the effect of speed increase of the image output apparatus (increase of frictional heat at the contact portion) and the effect of increase in frequency of double-sided output (because the heated paper returns to the apparatus), when the apparatus is used in a high-temperature and high-humidity environment, the temperature inside the apparatus is easily raised, and the toner is more likely to be exposed to high temperatures.

When a repeated use test is conducted in such a usage environment, toner deterioration, such as softening in the vicinity of the toner particle surface, embedding of external additives, crushing or cracking of toner particles and the like, proceeds, and the density of the image outputted after the repeated use test is likely to decrease.

SUMMARY OF THE INVENTION

Japanese Patent Application Publication No. 2013-137420 discloses a toner including a crystalline polyester that produces a certain effect on low-temperature fixability. However, when the toner is used in a severe environment where the toner is exposed to high temperature, for example, when performing double-sided continuous output in a high-temperature and high-humidity environment, it is difficult to maintain high image quality after a repeated use test, and there is still room for improvement.

Further, Japanese Patent Application Publication No. 2012-93752 proposes a magnetic toner in which magnetic bodies are dispersed using an aggregation method, but as in the case of Japanese Patent Application Publication No. 2013-137420, there is room for improvement in terms of achieving both low-temperature fixability and durability.

Meanwhile, enhancing the cooling capacity of the image output apparatus and providing downtime control can be used as means for avoiding the situation where the toner is easily exposed to high temperature, but the former can restrict miniaturization, and the latter can lead to a decrease in printing speed.

Therefore, it is required to improve the durability of the toner, but in the toner including the aforementioned crystalline polyester, although the melting deformation of the binder resin at the time of fixing is promoted, the toner tends to have low resistance to shear in a high-temperature and high-humidity environment, and there is room for improvement in combining the durability with low-temperature fixability.

That is, in the one-component contact development system in which a strong shear force is applied to the toner, there is room for improvement in achieving both the low-temperature fixability and the durability in the mode of continuous double-sided output in a high-temperature and high-humidity environment. The present invention solves the above problems. That is, the present invention provides a magnetic toner having satisfactory low-temperature fixability and satisfactory image density even in repeated testing in a mode of continuous double-sided output in a high-temperature and high-humidity environment even when using a one-component contact development system in which a strong shear force is applied to the toner.

The inventors of the present invention have found that, in a magnetic toner including a crystalline polyester, the above problems can be solved by setting a specific relationship between storage elastic moduli obtained by powder dynamic viscoelasticity measurement, and the present invention has been accomplished based on this finding.

That is, the present invention provides a magnetic toner comprising a magnetic toner particle including a binder resin, a magnetic body and a crystalline polyester, wherein a storage elastic modulus E'(40) [Pa] at 40° C. and a storage elastic modulus E'(85) [Pa] at 85° C., which are obtained in a powder dynamic viscoelasticity measurement of the magnetic toner, satisfy the following formulas (1) to (3).

$$E'(40) \geq 6.0 \times 10^9 \quad (1)$$

$$E'(85) \leq 5.5 \times 10^9 \quad (2)$$

$$[E'(40) - E'(85)] \times 100 / E'(40) \geq 40 \quad (3)$$

According to the present invention, it is possible to provide a magnetic toner having satisfactory low-temperature fixability and satisfactory image density even in repeated testing in a mode of continuous double-sided output in a high-temperature and high-humidity environment even when using a one-component contact development system in which a strong shear force is applied to the toner.

Further features of the present invention will become apparent from the following description of exemplary embodiments with reference to the attached drawings.

DESCRIPTION OF THE EMBODIMENTS

Figure 1:
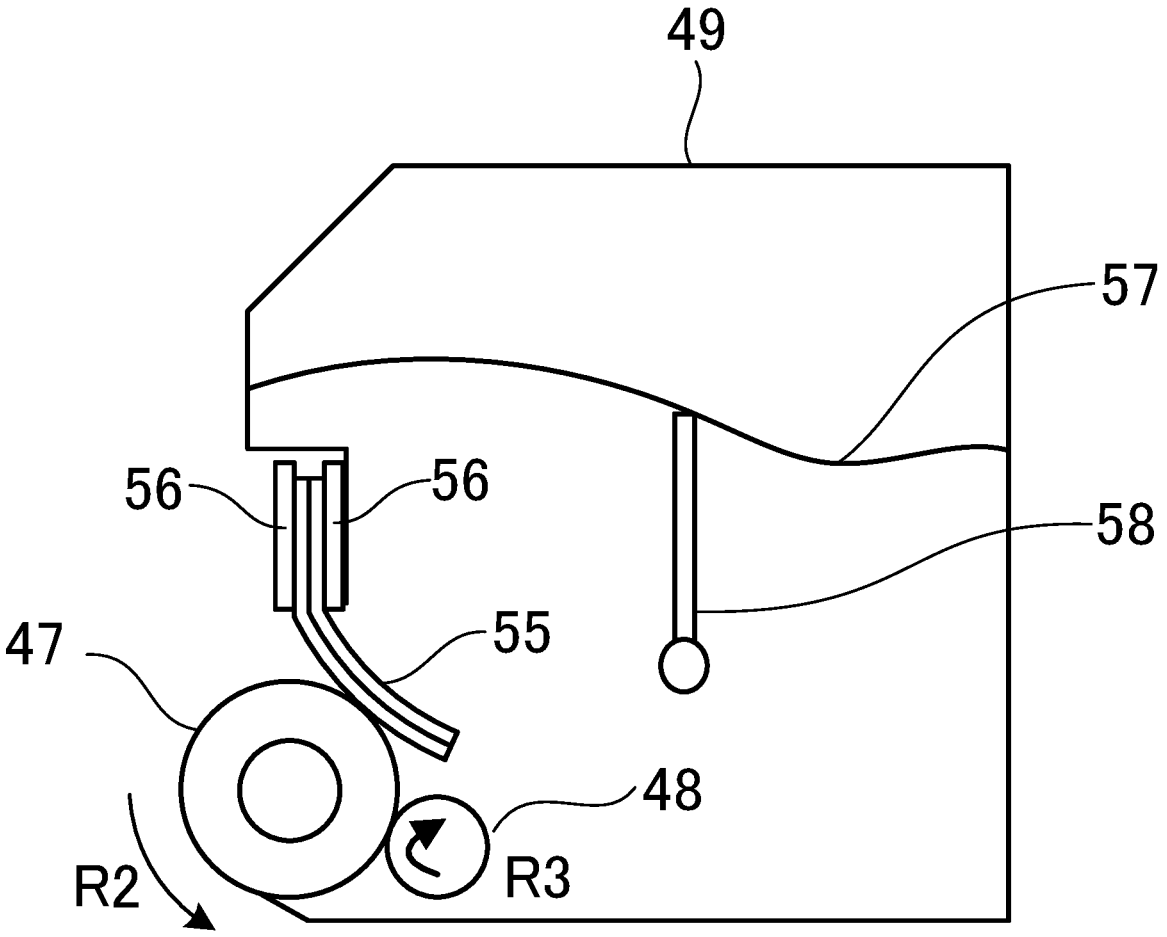
FIG. 1 is a schematic sectional view of a developing device.

In the present invention, the descriptions of "from XX to YY" or "XX to YY" representing a numerical range mean a numerical range including the lower limit and the upper limit which are endpoints, unless otherwise noted.

The toner of the present invention is a magnetic toner comprising a magnetic toner particle including a binder resin, a magnetic body and a crystalline polyester, wherein a storage elastic modulus E'(40) [Pa] at 40° C. and a storage elastic modulus E'(85) [Pa] at 85° C., which are obtained in a powder dynamic viscoelasticity measurement of the magnetic toner, satisfy the following formulas (1) to (3).

$$E'(40) \geq 6.0\times10^{9} \quad (1)$$

$$E'(85) \leq 5.5\times10^{9} \quad (2)$$

$$[E'(40)-E'(85)]\times100/E'(40) \geq 40 \quad (3)$$

First, the inventors of the present invention have understood that when a toner including a crystalline polyester is used in an image output apparatus of a one-component contact development system, and a test is conducted in a mode in which double-sided continuous output is performed in a high-temperature and high-humidity environment, a problem is associated with the decrease in image density in the second half of the service life of the cartridge. The mode in which double-sided continuous output is performed in a high-temperature and high-humidity environment may hereinafter be referred to simply as the double-sided continuous output mode.

It was understood that the cause of the problem is that the vicinity of the surface of the toner particle after the repeated test is easily softened.

Further, when the cartridge wall surface temperature in the vicinity of the toner bearing member is measured, it can be 40° C. or higher, so it is presumed that the toner temperature is also locally 40° C. or higher.

From the above, the inventors of the present invention came to the idea that in order to reduce the difference in image density between before and after the repeated test, it is important that the elasticity in the vicinity of the toner particle surface at 40° C. be equal to or greater than a predetermined level.

The toner of the present invention needs to satisfy the following formula (1).

$$E'(40) \geq 6.0\times10^{9} \quad (1)$$

Based on the results of comprehensive research, the inventors of the present invention have found that durability of the toner in the double-sided continuous output mode can be increased by increasing the storage elastic modulus E'(40) [Pa] at 40° C. which is obtained in a powder dynamic viscoelasticity measurement. By satisfying the formula (1), the difference in image density between before and after the repeated test is reduced.

The powder dynamic viscoelasticity measurement is performed by the method described hereinbelow. The inventors of the present invention believe that the measurement reflecting the information on viscoelasticity in the vicinity of the toner particle surface can be performed because the toner is provided for the measurement in the powder state, without forming the toner into a pellet or the like. Therefore, E'(40) [Pa], which is a storage elastic modulus at 40° C., represents the elastic modulus in the vicinity of the toner particle surface at 40° C. of the toner in the solid state which is the powder state, and it is assumed that where the value thereof is high, the vicinity of the toner particle surface is firm.

E'(40) is preferably $6.3\times10^{9}$ or more, and more preferably $6.7\times10^{9}$ or more. Meanwhile, the upper limit is not particularly limited, but is preferably $2.0\times10^{10}$ or less, and more preferably $1.0\times10^{10}$ or less.

Further, the inventors of the present invention have understood that where a toner including a crystalline polyester is sheared in a high-temperature and high-humidity environment, the crystalline polyester partially out-migrates from the inside of the toner particle to the vicinity of the surface, and the vicinity of the surface tends to be selectively softened.

Accordingly, in the toner of the present invention, in order to satisfy the above E'(40), it is preferable to suppress the outmigration of the crystalline polyester when a shear force is applied in a high-temperature and high-humidity environment. Specifically, as described hereinbelow, it is preferable to control the presence state of the magnetic body inside the toner particle, to use an amorphous polyester for the binder resin, and to control the monomer constitution, amount and dispersion state of the crystalline polyester.

The toner of the present invention needs to satisfy the following formula (2).

$$E'(85) \leq 5.5\times10^{9} \quad (2)$$

Based on the results of comprehensive research, the inventors of the present invention have found that setting E'(85) [Pa] at 85° C., which is obtained in a powder dynamic viscoelasticity measurement, to $5.5\times10^{9}$ or less is preferable because adhesion to paper, which is an index of low-temperature fixability, is enhanced. Specifically, it is preferable because the rate of rubbing-induced decrease in density of halftone images can be reduced.

The reason why the rate of rubbing-induced decrease in density can be reduced when E'(85) [Pa] satisfies the above formula (2) is considered hereinbelow. The temperature at which the toner starts to be fixed in the fixing nip is around 85° C., and it is conceivable that a low elastic modulus in this temperature range induces the wetting and spreading of the toner on the paper and improves the adhesion to the paper.

E'(85) [Pa] is preferably $5.0\times10^{9}$ or less, and more preferably $4.0\times10^{9}$ or less, from the viewpoint of further improving the rate of rubbing-induced decrease in density. Meanwhile, the lower limit is not particularly limited, but is preferably $5.0\times10^8$ or more, and more preferably $1.0\times10^9$ or more.

E'(85) can be controlled by the storage modulus of the binder resin and the amount of the crystalline polyester. The storage elastic modulus of the binder resin can be controlled by appropriately adjusting the types and molecular weights of constituent monomers.

The toner of the present invention needs to satisfy the following formula (3).

$$[E'(40)-E'(85)]\times100/E'(40)\geq40 \quad (3)$$

Based on the results of comprehensive research, the inventors of the present invention have found that where E'(85) indicating the storage elastic modulus of the melted toner satisfies the formula (2), and further, E'(40) and E'(85) satisfy the relationship represented by the formula (3), the fixability of a solid image in a low-temperature and low-humidity environment can be improved. Where the formula (3) is satisfied, the cold offset resistance of a solid image, which is an index of low-temperature fixability, is improved.

The inventors consider the following reason therefor.

A solid image has more toner laid on the paper than a halftone image, and it is conceivable that the heat from the fixing device is less likely to be transmitted to the toner on the lowermost layer on the paper.

Therefore, in order to improve the fixability of the solid image, it is necessary not only to improve the adhesion between the toner and the paper in the fixed image but also to promote the melt adhesion between the toner particles, and it led to the idea that increasing the melting rate of the toner particle surface is important to achieve this object.

As mentioned hereinabove, E'(40) and E'(85) are values reflecting the elastic modulus in the vicinity of the toner particle surface before the fixing and in the fixing nip, respectively. Therefore, where the rates of change thereof satisfy the formula (3), it indicates that the melting speed of the toner particle surface in the fixing nip is high.

Therefore, it is conceivable that where the formula (3) is satisfied in addition to the formula (2), the surface melt adhesion between the toner particles is promoted, and the fixability of the solid image can be improved.

[E'(40)−E'(85)]×100/E'(40) is preferably 45 or more, more preferably 50 or more. Meanwhile, the upper limit is not particularly limited, but is preferably 80 or less, and more preferably 75 or less.

In order for the toner of the present invention to satisfy all of the formulas (1) to (3), it is preferable that the magnetic bodies be unevenly distributed in a state of being aggregated to some extent in the toner particle. Specifically, a range of CV3 described hereinbelow is preferable. It is also preferable to use an amorphous polyester as the binder resin, and to control the monomer constitution, amount and dispersion state of the crystalline polyester.

The control of the presence state of the magnetic bodies preferable in the present invention will be described hereinbelow.

The inventors of the present invention have comprehensively studied toners that make it possible to achieve both low-temperature fixability and durability in the double-sided continuous output mode in a system in which strong shear is applied, such as a one-component contact development system.

As a result, it has been found that where the magnetic bodies present in the magnetic toner particle are present in a state of being aggregated to some extent, the storage elastic modulus in the vicinity of the toner particle surface in the solid state can be easily enhanced while improving the sharp melt property controlled by the crystalline polyester.

Where the magnetic bodies are unevenly distributed in a state of being aggregated to some extent, the binder resin is unevenly distributed in the form of domains in the toner particle, portions free of the magnetic particles are formed (hereinafter also referred to as domains of the binder resin), and these domains exert an effect of absorbing and dispersing the external shear applied to the magnetic toner.

As a result, even when shear is applied in a high-temperature and high-humidity environment, micro-deformation inside the toner particle is suppressed, and molecular motion in which the crystalline polyester out-migrates to the vicinity of the toner particle surface is unlikely to occur.

In addition, the effect of trapping the crystalline polyester which is likely to out-migrate to the vicinity of the toner particle surface by the aggregated magnetic bodies is also exhibited, and it is presumed that this is why the plasticization in the vicinity of the toner particle surface is suppressed and the storage elastic modulus in the solid state is enhanced.

Meanwhile, in the temperature range where the toner can be melted, the dispersed state of the magnetic bodies is collapsed, so the effect of absorbing and dispersing the shear by the domains of the binder resin is lost, and the outmigration of the crystalline polyester from inside of the toner particle to the vicinity of the surface is promoted. Therefore, it is conceivable that the vicinity of the toner particle surface is efficiently plasticized.

These factors act synergistically and are presumed to be represented by the set of formulas (1) to (3).

The inventors of the present invention have found a means capable of forming a state in which the magnetic bodies are aggregated to some extent in each toner particle. Then, it has been found that by using the means, it is easy to achieve both the low-temperature fixability and the durability in the double-sided continuous mode.

In the magnetic toner in which in cross-sectional observation of the magnetic toner particle using a transmission electron microscope TEM, a variation coefficient CV3 of the occupied area ratio of the magnetic bodies when a cross section of the magnetic toner particle is divided by a square grid having a side of 0.8 μm is preferably from 40.0% to 90.0%. CV3 is more preferably from 45.0% to 85.0%, and still more preferably from 50.0% to 80.0%.

CV3 is an index representing the degree of uneven distribution of the magnetic bodies in the magnetic toner particle, and a larger value thereof indicates a more uneven distribution. When CV3 is in the above range, it means that the magnetic bodies are locally unevenly distributed in the magnetic toner particle.

Further, by causing the magnetic bodies to be unevenly distributed in the magnetic toner particle, it is possible to appropriately provide a portion where the magnetic bodies are not present (that is, the domain portion of the binder resin), and the shear from the outside can be absorbed in this portion. Therefore, the above range is preferable because it becomes easy to maintain E'(85) and raise E'(40) as described above.

Moreover, it is preferable that CV3 be 40.0% or more because fogging after the repeated use test in a high-temperature and high-humidity environment can be improved. This is because where the magnetic bodies are present in a state of being aggregated to some extent and separated from each other, cracking of the toner particle is suppressed even in a system with high shear, such as a one-component contact development system, and charging performance is satisfactory even when image output is performed multiple times.

It is also preferable that the magnetic bodies be present in the magnetic toner particle in a state of aggregation to a certain degree because charge leakage from the toner particle to the electrostatic latent image bearing member and the like can be suppressed in a high-temperature and high-humidity environment, and an image with less fogging can be stably outputted.

Meanwhile, when CV3 is 90.0% or less, the magnetic bodies are appropriately dispersed in the toner. Therefore, it is preferable that this condition be met because the tinting strength created by the magnetic bodies is sufficiently developed, and the initial image density in a high-temperature and high-humidity environment is further improved.

Controlling the hydrophilicity/hydrophobicity of the surface of the magnetic body, controlling the degree of aggregation of the magnetic bodies at the time of production of toner particles, and the like can be mentioned as methods for adjusting CV3 to the above-mentioned range.

For example, in the case of using the emulsion aggregation method, a method of aggregating the magnetic bodies in advance and introducing the aggregate into the toner particle, or a method of adding a chelating agent and/or adjusting the pH in the coalescence step to adjust the degree of aggregation of the magnetic bodies can be used.

It is preferable that the brightness and the brightness dispersion value of the magnetic toner be controlled.

Generally, it is preferable that in the toner including magnetic bodies, the magnetic bodies be contained more uniformly among the toner particles. When toner particles having different amounts of magnetic bodies are present, the charging performance and magnetic performance will be different. In that case, especially in a system having magnetic conveyance or in a system in which development is performed by controlling the charging performance and magnetic performance of the toner, the behavior at the time of development may differ among the toner particles, and as a result, image defects such as decrease in density can occur.

In addition, the brightness of the toner is an index indicating the degree of light scattering by the toner, and the brightness of the toner is lowered by including a colorant or a substance such as a magnetic body that absorbs light.

Meanwhile, the brightness dispersion value of the toner is an index showing how much the brightness is uneven in one toner particle in the measurement of the brightness. Therefore, the variation coefficient of the brightness dispersion value serves as an index showing how much the brightness varies among the toner particles.

It is preferable to control the content ratio of the magnetic bodies among the magnetic toner particles and to set the brightness and the variation coefficient of brightness dispersion value of the magnetic toner to appropriate values because an image with satisfactory image density and small fogging is obtained even when the image is outputted after long-term storage in a high-temperature and high-humidity environment.

The number average particle diameter of the magnetic toner is Dn (μm),

The average brightness at Dn of the magnetic toner is preferably from 30.0 to 60.0, and more preferably from 35.0 to 50.0.

When the average brightness is in the above range, it indicates that the average amount of magnetic bodies in the toner particles is appropriate. Therefore, it is possible to suppress the charge relaxation from the toner particles present in the contact portion through the magnetic bodies, and the charging stability is enhanced even when the toner is allowed to stand in an environment where the charge relaxation or charge leakage easily occurs, such as a high-temperature and high-humidity environment.

The average brightness of 30.0 or more is preferable because an image with less fogging can be outputted even when the toner is allowed to stand for a long time in a high-temperature and high-humidity environment. Meanwhile, it is preferable that the average brightness be 60.0 or less, because an image with a smaller decrease in image density can be outputted even when the toner is allowed to stand for a long time in a high-temperature and high-humidity environment.

The average brightness can be adjusted to the above range by adjusting the amount of the magnetic bodies.

Further, where the variation coefficient of the brightness dispersion value of the magnetic toner in a range from Dn−0.500 to Dn+0.500 is denoted by CV1 (%), and the variation coefficient of the brightness dispersion value of the magnetic toner in a range from Dn−1.500 to Dn−0.500 is denoted by CV2 (%), the CV1 and the CV2 preferably satisfy the following formula (5).

$$CV2/CV1 \leq 1.00 \quad (5)$$

CV2/CV1 is more preferably from 0.70 to 0.95.

When CV2/CV1 is in the above range, the amount of the magnetic bodies in the magnetic toner particle hardly depends on the particle diameter of the toner particle. As a result, charging unevenness of the toner particles and magnetic property unevenness are suppressed, and even when image output is performed multiple times, the developing performance is satisfactory and the uniformity of image density is satisfactory.

As a means for controlling CV2/CV1 to the above range, adjusting the particle diameter of the magnetic bodies can be mentioned. In addition, toner particles may be manufactured using a pulverization method, an emulsion aggregation method, or the like, in which the magnetic bodies are easily taken into small diameter particles.

CV1 and CV2 can be adjusted by controlling the dispersion state of the magnetic bodies at the time of production of toner particles.

The binder resin is not particularly limited, and a known resin for toner can be used. Specific examples of the binder resin include amorphous polyester resins, polyurethane resin, and vinyl resins.

Examples of the monomers that can be used for the production of vinyl resins are listed hereinbelow.

Aliphatic vinyl hydrocarbons: alkenes such as ethylene, propylene, butene, isobutylene, pentene, heptene, diisobutylene, octene, dodecene, octadecene, and other α-olefins; and alkadienes, such as butadiene, isoprene, 1,4-pentadiene, 1,6-hexadiene and 1,7-octadiene.

Alicyclic vinyl hydrocarbons: mono- or di-cycloalkenes and alkadienes, such as cyclohexene, cyclopentadiene, vinylcyclohexene, and ethylidenebicycloheptene; and terpenes such as pinene, limonene, and indene.

Aromatic vinyl hydrocarbons: styrene and hydrocarbyl (alkyl, cycloalkyl, aralkyl and/or alkenyl) substituents thereof, such as α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, trivinylbenzene; and vinylnaphthalene.

Carboxy group-containing vinyl-based monomers and metal salts thereof: unsaturated monocarboxylic acids having from 3 to 30 carbon atoms, unsaturated dicarboxylic acids, anhydrides thereof and monoalkyl (from 1 to 27 carbon atoms) esters thereof. For example, carboxy group-containing vinyl-based monomers such as acrylic acid, methacrylic acid, maleic acid, maleic anhydride, monoalkyl esters of maleic acid, fumaric acid, monoalkyl esters of fumaric acid, crotonic acid, itaconic acid, monoalkyl esters of itaconic acid, glycol monoether itaconate, citraconic acid, citraconic acid monoalkyl esters, and cinnamic acid.

Vinyl esters, such as vinyl acetate, vinyl butyrate, vinyl propionate, butyric acid vinyl ester, diallyl phthalate, diallyl adipate, isopropenyl acetate, vinyl methacrylate, methyl 4-vinyl benzoate, cyclohexyl methacrylate, benzyl methacrylate, phenyl acrylate, phenyl methacrylate, vinyl methoxyacetate, vinyl benzoate, ethyl α-ethoxy acrylate, alkyl acrylates and alkyl methacrylates having an alkyl group (linear or branched) having from 1 to 22 carbon atoms (methyl acrylate, methyl methacrylate, ethyl acrylate, ethyl methacrylate, propyl acrylate, propyl methacrylate, butyl acrylate, butyl methacrylate, 2 ethylhexyl acrylate, 2-ethylhexyl methacrylate, lauryl acrylate, lauryl methacrylate, myristyl acrylate, myristyl methacrylate, cetyl acrylate, cetyl methacrylate, stearyl acrylate, stearyl methacrylate, eicosyl acrylate, eicosyl methacrylate, behenyl acrylate, behenyl methacrylate, and the like), dialkyl fumarates (fumaric acid dialkyl ester, two alkyl groups are linear, branched or alicyclic groups having from 2 to 8 carbon atoms), dialkyl maleates (maleic acid dialkyl ester, two alkyl groups are linear, branched or alicyclic group having from 2 to 8 carbon atoms), polyaryloxyalkanes (diaryloxyethane, triaryloxyethane, tetraaryloxyethane, tetraaryloxypropane, tetraaryloxybutane, and tetramethallyloxyethane), vinyl-based monomers having a polyalkylene glycol chain (polyethylene glycol (molecular weight 300) monoacrylate, polyethylene glycol (molecular weight 300) monomethacrylate, polypropylene glycol (molecular weight 500) monoacrylate, polypropylene glycol (molecular weight 500) monomethacrylate, methyl alcohol ethylene oxide (ethylene oxide is hereinafter abbreviated as EO) 10 mole adduct acrylate, methyl alcohol ethylene oxide 10 mole adduct methacrylate, lauryl alcohol EO 30 mole adduct acrylate, lauryl alcohol EO 30 mole adduct methacrylate), polyacrylates and polymethacrylates (polyacrylates and polymethacrylates of polyhydric alcohols: ethylene glycol diacrylate, ethylene glycol dimethacrylate, propylene glycol diacrylate, propylene glycol dimethacrylate, neopentyl glycol diacrylate, neopentyl glycol dimethacrylate, trimethylolpropane triacrylate, trimethylolpropane trimethacrylate, polyethylene glycol diacrylate, and polyethylene glycol dimethacrylate).

Carboxy group-containing vinyl esters: for example, carboxyalkyl acrylates having an alkyl chain having from 3 to 20 carbon atoms, and carboxyalkyl methacrylates having an alkyl chain having from 3 to 20 carbon atoms.

Among these, styrene, butyl acrylate, β-carboxyethyl acrylate and the like are preferable.

Examples of monomers that can be used for the manufacture of the amorphous polyester resin include conventionally well-known bivalent, trivalent or higher carboxylic acids and dihydric, trihydric or higher alcohols. Specific examples of these monomers are listed hereinbelow.

Examples of the divalent carboxylic acids include dibasic acids such as oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, phthalic acid, isophthalic acid, terephthalic acid, dodecenyl succinic acid and the like, anhydrides thereof or lower alkyl esters thereof, and aliphatic unsaturated dicarboxylic acids such as maleic acid, fumaric acid, itaconic acid, citraconic acid and the like. Lower alkyl esters of these dicarboxylic acids and acid anhydrides can also be used.

Further, examples of trivalent or higher carboxylic acids include 1,2,4-benzenetricarboxylic acid, 1,2,5-benzenetricarboxylic acid, anhydrides thereof, lower alkyl esters thereof, and the like.

These may be used singly, or two or more thereof may be used in combination.

Examples of dihydric alcohols include alkylene glycols (1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-icosandiol); alkylene ether glycols (polyethylene glycol and polypropylene glycol); alicyclic diols (1,4-cyclohexanedimethanol); bisphenols (bisphenol A); alkylene oxide (ethylene oxide and propylene oxide) adducts of alicyclic diols, and alkylene oxide (ethylene oxide and propylene oxide) adducts of bisphenols (bisphenol A).

The alkyl moieties of the alkylene glycol and the alkylene ether glycol may be linear or branched. In the present invention, an alkylene glycol having a branched structure can also be preferably used.

In addition, aliphatic diols having a double bond can also be used. The following compounds can be mentioned as aliphatic diols having a double bond.

2-Butene-1,4-diol, 3-hexene-1,6-diol and 4-octene-1,8-diol.

Further, examples of the trihydric or higher alcohols include glycerin, trimethylolethane, trimethylolpropane and pentaerythritol.

These may be used singly, or two or more thereof may be used in combination.

For the purpose of adjusting the acid value and the hydroxyl value, a monobasic acid such as acetic acid and benzoic acid, and a monohydric alcohol such as cyclohexanol and benzyl alcohol can also be used, if necessary.

A method for synthesizing the amorphous polyester resin is not particularly limited, and for example, a transesterification method or a direct polycondensation method can be used singly or in combination.

Next, the polyurethane resin is described.

The polyurethane resin is a reaction product of a diol and a compound including a diisocyanate group. By combining various diols and compounds including a diisocyanate group, polyurethane resins having various functionalities can be obtained.

The compounds containing a diisocyanate group can be exemplified by aromatic diisocyanates having from 6 to 20 carbon atoms (excluding carbon in an NCO group, the same applies hereinafter), aliphatic diisocyanates having from 2 to 18 carbon atoms, alicyclic diisocyanates having from 4 to 15 carbon atoms and modified products of these diisocyanates (modified products including an urethane group, a carbodiimide group, an allophanate group, an urea group, a biuret group, an uretdione group, an uretimine group, an isocyanurate group or an oxazolidone group; can be also referred to hereinbelow as "modified diisocyanates"), and mixtures of two or more thereof.

Examples of the aromatic diisocyanates include m- and/or p-xylylene diisocyanate (XDI) and α,α,α',α'-tetramethyl xylylene diisocyanate and the like.

Examples of the aliphatic diisocyanates include ethylene diisocyanate, tetramethylene diisocyanate, hexamethylene diisocyanate (HDI), dodecamethylene diisocyanate and the like.

Further, examples of the alicyclic diisocyanates include isophorone diisocyanate (IPDI), dicyclohexylmethane-4,4'-diisocyanate, cyclohexylene diisocyanate, methylcyclohexylene diisocyanate and the like.

Among these, aromatic diisocyanates having from 6 to 15 carbon atoms, aliphatic diisocyanates having from 4 to 12 carbon atoms, and alicyclic diisocyanates having from 4 to 15 carbon atoms are preferable, and XDI, IPDI and HDI are more preferable. In addition to the above diisocyanates, trifunctional or higher functional isocyanate compounds can also be used.

A diol that can be used for a polyurethane resin can be exemplified by the same dihydric alcohols that can be used for the polyester mentioned above.

Resins such as an amorphous polyester resin, a polyurethane resin, and a vinyl resin may be used singly or in combination of two or more as the binder resin.

In particular, the binder resin preferably includes an amorphous polyester resin, and more preferably includes an amorphous polyester including a monomer unit derived from an aromatic diol and/or a monomer unit derived from an aromatic dicarboxylic acid. Further, the monomer unit means the reacted form of the monomer substance in a polymer.

It is preferable that the binder resin include such a polyester because the charge stability and charge rising performance of the toner in a high-temperature and high-humidity environment become satisfactory and the density uniformity of the solid image becomes satisfactory.

It is preferable to use an amorphous polyester as described above, because E'(40) is high and a low E'(85) is easy to design.

It is easy to increase E'(40) because the rigidity of the monomer unit of the amorphous polyester is high and the interaction between molecules is also high, so that the elastic modulus in the solid state of the toner particle can be easily increased.

Meanwhile, a low E'(85) is easy to design because the amorphous polyester is likely to become rapidly compatible with the crystalline polyester at the time of fixing, and the sharp melt property of the toner tends to be enhanced.

Examples of monomer units derived from aromatic diols include monomer units derived from bisphenols (bisphenol A) and alkylene oxide (ethylene oxide, propylene oxide) adducts of bisphenols.

Examples of monomer units derived from aromatic dicarboxylic acids include monomer units derived from terephthalic acid, isophthalic acid, 2,6-naphthalenedicarboxylic acid, 4,4-biphenyldicarboxylic acid, anhydrides thereof, lower alkyl esters thereof, and the like.

From the viewpoint of obtaining more satisfactory uniformity of a solid image, the proportion of a monomer unit derived from an aromatic diol and a monomer unit derived from an aromatic dicarboxylic acid is preferably 80 mol % or more, and more preferably 85 mol % or more on the basis of all the monomer units constituting the amorphous polyester. The upper limit is not particularly limited and may be 100 mol % or less.

From the viewpoint of low-temperature fixability, the glass transition temperature (Tg) of the binder resin is preferably from 40.0° C. to 80.0° C. The softening point is preferably from 80° C. to 150° C. Further, from the viewpoint of low-temperature fixability and durability of the toner, the weight average molecular weight of the binder resin is preferably from 8000 to 1,200,000, and more preferably from 40,000 to 300,000.

The amorphous polyesters may be used in combination of two or more, or may be in the form of a composite resin in which the resins are chemically bonded.

The toner particle includes a crystalline polyester. The crystalline polyester is preferably a polycondensate of monomers including an aliphatic diol and/or an aliphatic dicarboxylic acid. The crystalline resin means a resin which shows a clear melting point by the measurement using a differential scanning calorimeter (DSC).

The crystalline polyester preferably includes a monomer unit derived from an aliphatic diol having 2 to 12 (more preferably 6 to 12) carbon atoms, and/or a monomer unit derived from an aliphatic dicarboxylic acid having 2 to 12 (more preferably 6 to 12 carbon atoms).

With the crystalline polyester having such a structure, the dispersibility of the crystalline polyester among the toner particles is improved, and the unevenness of wetting and spreading among the toner particles at the time of fixing can be suppressed, so that the uniformity of the halftone image is improved.

Examples of the aliphatic diol having from 2 to 12 carbon atoms include the following compounds.

1,2-Ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, and 1,12-dodecanediol.

In addition, an aliphatic diol having a double bond can also be used. The aliphatic diol having a double bond can be exemplified by the following compounds.

2-Butene-1,4-diol, 3-hexene-1,6-diol and 4-octene-1,8-diol.

The aliphatic dicarboxylic acid having from 2 to 12 carbon atoms can be exemplified by the following compounds.

Oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid. Lower alkyl esters and acid anhydrides of these aliphatic dicarboxylic acids can also be used.

Among these, sebacic acid, adipic acid and 1,10-decanedicarboxylic acid and lower alkyl esters and acid anhydrides thereof are preferred. These may be used singly or in combination of two or more thereof.

In addition, an aromatic carboxylic acid can also be used. The aromatic dicarboxylic acid can be exemplified by the following compounds. Terephthalic acid, isophthalic acid, 2,6-naphthalenedicarboxylic acid and 4,4'-biphenyldicarboxylic acid. Among these, terephthalic acid is preferable from the standpoint of easy availability and easy formation of a polymer having a low melting point.

Also, a dicarboxylic acid having a double bond can be used. The dicarboxylic acid having a double bond can be suitably used in order to suppress the hot offset at the time of fixing because such an acid makes it possible to crosslink the entire resin by using the double bond.

Such a dicarboxylic acid can be exemplified by fumaric acid, maleic acid, 3-hexenediodic acid and 3-octendenic acid. Also included are lower alkyl esters and acid anhydrides thereof. Among these, fumaric acid and maleic acid are more preferable.

A method for manufacturing a crystalline polyester is not particularly limited, and can be implemented by the general polymerization method of polyesters in which a dicarboxylic acid component and a diol component are reacted with each other. For example, direct polycondensation or transesterification can be used depending on the type of monomers.

The peak temperature of the maximum endothermic peak measured using differential scanning calorimetry (DSC) of the crystalline polyester is preferably from 50.0° C. to 100.0° C., and from the viewpoint of low temperature fixability, the peak temperature is more preferably from 60.0° C. to 90.0° C.

The amount of the crystalline polyester in the magnetic toner is preferably from 3.0% by mass to 20.0% by mass. Within this range, the relationship between E'(40) and E'(85) of the toner can be easily set in a preferable range to obtain a toner with satisfactory balance of low-temperature fixability and durability.

It is preferable that in a cross section of the magnetic toner particle observed with a transmission electron microscope, the domains of the crystalline polyester be present inside the magnetic toner particle. The number average diameter of the domains is preferably from 50 nm to 500 nm, and more preferably from 50 nm to 400 nm.

When the number average diameter of the domains of the crystalline polyester is in the above range, excessive aggregation of the magnetic bodies can be suppressed, and the binder resin can be efficiently plasticized. Therefore, even when heat is repeatedly applied from the fixing unit, the melted state of the toner is easily stabilized, and the difference between the image density of the first side and that of the second side at the time of double-sided printing can be reduced.

Regarding the number average diameter of the domains, in cross-sectional observation of a magnetic toner particle using a transmission electron microscope TEM, 30 domains of the crystalline polyester having a major axis of 20 nm or more are randomly selected, the average value of the major and minor axes is taken as the domain diameter, and the average value of 30 domains is taken as the number average diameter of the domains. The selection of the domains does not have to be in the same toner particle.

The number average diameter of the domains can be adjusted by the addition amount of the crystalline polyester, or when the emulsion aggregation method is used as a method for producing the toner, by the diameter of the crystalline polyester particles in the crystalline polyester-dispersed solution, the retention time in the coalescence step, the cooling rate after coalescing, and the like.

Further, in cross-sectional observation of a magnetic toner particle using a transmission electron microscope TEM, a variation coefficient CV4 of the occupied area ratio of the crystalline polyester when the cross section of the magnetic toner particle is divided by a square grid having a side of 0.8 μm is preferably 30.0% to 90.0%, and more preferably 35.0% to 85.0%.

CV4 is an index showing the degree of uneven distribution of the crystalline polyester in the magnetic toner particle, and a larger value thereof indicates a larger degree of uneven distribution.

The fact that CV4 is in the above range means that the crystalline polyester is unevenly localized in the magnetic toner particle.

It is preferable that CV4 be in the above range because the tape peel resistance of the image, which is an index of low-temperature fixability, is improved.

The reason for this is presumed to be that as a result of uneven distribution of the crystalline polyester in the magnetic toner particle, the crystalline polyester located in the toner particle easily out-migrates to the vicinity of the toner particle surface when heated in the fixing nip.

This is presumably why the adhesion between toner particles in the fixed image is enhanced, the release effect of the out-migrated crystalline polyester with the tape is exhibited, and the tape peel resistance is improved.

In addition, CV4 can be controlled and adjusted by a method of controlling the aggregation state of the magnetic bodies and changing the presence state thereof in the toner, which is described hereinabove, or when the emulsion aggregation method is used to produce the toner, by the crystalline polyester particle diameter in the crystalline polyester-dispersed solution and the retention time in the coalescence step, and also by a method of causing rapid solidification after the coalescence step.

The magnetic toner particle may include a wax.

A well-known wax may be used. Specific examples of the wax are presented hereinbelow.

Petroleum waxes such as paraffin wax, microcrystalline wax, petrolactam and the like and derivatives thereof, montan wax and derivatives thereof, hydrocarbon waxes obtained by a Fischer-Tropsch method and derivatives thereof, polyolefin waxes represented by polyethylene and polypropylene, and derivatives thereof, natural waxes such as carnauba wax, candelilla wax and derivatives thereof, ester waxes and the like.

Here, the derivatives include oxides, block copolymers with vinyl-based monomers, and graft modified products.

In addition, a monoester compound including one ester bond in a molecule and a polyfunctional ester compound such as a diester compound including two ester bonds in a molecule, a tetrafunctional ester compound including four ester bonds in a molecule, a hexafunctional ester compound including six ester bonds in a molecule and the like can be used as the ester wax.

The ester wax preferably includes at least one compound selected from the group consisting of monoester compounds and diester compounds.

Specific examples of the monoester compounds include waxes mainly composed of a fatty acid ester, such as carnauba wax, montanic acid ester wax and the like; compounds obtained by partial or complete removal of the acid component from a fatty acid ester, such as a deacidified carnauba wax and the like, compounds obtained by hydrogenation of vegetable oils and fats, and the like, and methyl ester compounds having a hydroxy group; and saturated fatty acid monoesters such as stearyl stearate and behenyl behenate.

Further, specific examples of the diester compound include dibehenyl sebacate, nonanediol dibehenate, dibehenyl terephthalate, distearyl terephthalate and the like.

In addition, the wax can include well-known other waxes other than the abovementioned compounds. Further, one type of wax may be used singly, or two or more types may be used in combination.

The amount of the wax is preferably from 1.0 part by mass to 30.0 parts by mass, and more preferably from 3.0 parts by mass to 25.0 parts by mass with respect to 100 parts by mass of the binder resin.

Examples of the magnetic body include iron oxides such as magnetite, maghemite, ferrite and the like; metals such as iron, cobalt, nickel and the like, alloys of these metals with a metal such as aluminum, copper, magnesium, tin, zinc, beryllium, calcium, manganese, selenium, titanium, tungsten, vanadium and the like, and mixtures thereof.

The number average particle diameter of the primary particles of the magnetic bodies is preferably 0.50 μm or less, and more preferably from 0.05 μm to 0.30 μm.

The number average particle diameter of the primary particles of the magnetic bodies present in the toner particle can be measured using a transmission electron microscope.

Specifically, after sufficiently dispersing toner particles to be observed in an epoxy resin, curing is performed in an atmosphere having a temperature of 40° C. for 2 days to obtain a cured product. The resulting cured product is sliced into a flaky sample by a microtome, an image at a magnification of 10,000 to 40,000 is captured in a transmission electron microscope (TEM), and the projected area of 100 primary particles of the magnetic bodies in the image is measured. Then, the equivalent diameter of the circle equal to the projected area is taken as the particle diameter of the primary particle of the magnetic body, and the average value of 100 particle diameters is taken as the number average particle diameter of the primary particles of the magnetic bodies.

As a magnetic property of the magnetic body at 795.8 kA/m application, a coercive force (Hc) is preferably 1.6 kA/m to 12.0 kA/m. The magnetization strength (σs) is preferably 50 $Am^2/kg$ to 200 $Am^2/kg$, and more preferably 50 $Am^2/kg$ to 100 $Am^2/kg$. Meanwhile, the residual magnetization (σr) is preferably 2 $Am^2/kg$ to 20 $Am^2/kg$. The amount of the magnetic bodies in the magnetic toner is preferably from 35% by mass to 50% by mass, and more preferably from 40% by mass to 50% by mass.

When the amount of the magnetic bodies is within the above range, the magnetic attraction with the magnet roll in the developing sleeve is appropriate.

The amount of the magnetic bodies in the magnetic toner can be measured using a thermal analyzer TGA Q5000IR manufactured by Perkin Elmer Co. The measurement method is as follows: the magnetic toner is heated from normal temperature to 900° C. at a temperature rise rate of 25° C./min in a nitrogen atmosphere, the mass lost at 100° C. to 750° C. is taken as the mass of the components other than the magnetic bodies in the magnetic toner, and the residual mass is taken as the mass of magnetic bodies.

The magnetic bodies can be produced, for example, by the following method.

An alkali such as sodium hydroxide or the like in an amount equivalent to the iron component or in a large amount is added to an aqueous ferrous salt solution to prepare an aqueous solution including ferrous hydroxide. Air is blown while maintaining the pH of the prepared aqueous solution at 7 or more, oxidation reaction of ferrous hydroxide is performed while heating the aqueous solution to 70° C. or more, and seed crystals to be the magnetic iron oxide cores are first generated.

Next, an aqueous solution including about 1 equivalent of ferrous sulfate based on the amount of alkali, which has been added previously, is added to the slurry including the seed crystals. The pH of the mixed solution is maintained at 5 to 10, the reaction of ferrous hydroxide is advanced while blowing the air, and magnetic iron oxide is grown on the seed crystals as the cores. At this time, it is possible to control the shape and magnetic properties of the magnetic bodies by selecting any pH, reaction temperature and stirring conditions. As the oxidation reaction proceeds, the pH of the mixture shifts to the acidic side, but the pH of the mixture should not be less than 5. Magnetic bodies can be obtained by filtering, washing and drying the magnetic bodies, which have been thus obtained, according to a conventional method.

In addition, the magnetic bodies may be subjected to known surface treatment as needed.

The magnetic toner particle may include a charge control agent. The magnetic toner is preferably a negative-charging toner.

Organometallic complex compounds and chelate compounds are effective as charge control agents for negative charge, and examples thereof include monoazo metal complex compounds; acetylacetone metal complex compounds; metal complex compounds of aromatic hydroxycarboxylic acid or aromatic dicarboxylic acid, and the like.

Specific examples of commercially available products include SPILON BLACK TRH, T-77, T-95 (Hodogaya Chemical Industry Co., Ltd.), and BONTRON (registered trademark) S-34, S-44, S-54, E-84, E-88, and E-89 (Orient Chemical Industry Co., Ltd.).

The charge control agents can be used singly or in combination of two or more thereof.

From the viewpoint of charge quantity, the amount of the charge control agent is preferably from 0.1 parts by mass to 10.0 parts by mass, and more preferably from 0.1 parts by mass to 5.0 parts by mass with respect to 100 parts by mass of the binder resin.

The glass transition temperature (Tg) of the magnetic toner is preferably from 45.0° C. to 70.0° C., and more preferably from 50.0° C. to 65.0° C.

When the glass transition temperature is in the above range, both storage stability and low-temperature fixability can be achieved at a high level. The glass transition temperature can be controlled by the composition of the binder resin, the type of the crystalline polyester, the molecular weight of the binder resin, and the like.

A method for producing the magnetic toner is not particularly limited, and any of dry production methods (for example, kneading and pulverizing method and the like) and wet production methods (for example, emulsion aggregation method, suspension polymerization method, dissolution and suspension method and the like) may be used. Among these, it is preferable to use the emulsion aggregation method.

It is preferable that the emulsion aggregation method be used because the variation coefficient of the brightness dispersion value of the magnetic toner, the variation coefficient of the occupied area ratio of the magnetic material, the number average diameter of domains of the crystalline polyester, the variation coefficient of the occupied area ratio of the crystalline polyester, and the like can be easily adjusted to the abovementioned ranges.

A method for producing toner particles by using the emulsion aggregation method will be described by way of specific examples.

The emulsion aggregation method is roughly divided into the following four steps.

(a) A step of preparing fine particle-dispersed solution, (b) an aggregation step of forming aggregated particles, (c) a coalescence step of forming toner particles by melting and coalescence, and (d) a washing and drying step.

(a) Step of Preparing Fine Particle-Dispersed Solution

A particle-dispersed solution is obtained by dispersing fine particles of each material such as a binder resin, a magnetic body and a crystalline polyester in an aqueous medium.

Examples of the aqueous medium include water such as distilled water, ion exchange water, and the like and alcohols. These may be used singly or in combination of two or more thereof.

An auxiliary agent for dispersing the fine particles in the aqueous medium may be used, surfactants being examples of the auxiliary agent.

Surfactants include anionic surfactants, cationic surfactants, amphoteric surfactants, and nonionic surfactants.

Specific examples include anionic surfactants such as alkylbenzene sulfonates, α-olefin sulfonates, and phosphoric acid esters; cationic surfactants of amine salt type such as alkylamine salts, amino alcohol fatty acid derivatives, polyamine fatty acid derivatives, and imidazoline, or quaternary ammonium salt type such as alkyl trimethyl ammonium salts, dialkyl dimethyl ammonium salts, alkyl dimethyl benzyl ammonium salts, pyridinium salts, alkyl isoquinolinium salts, and benzethonium chloride; nonionic surfactants such as fatty acid amide derivatives and polyhydric alcohols derivatives; and amphoteric surfactants such as alanine, dodecyldi(aminoethyl) glycine, di(octylaminoethyl) glycine and N-alkyl-N,N-dimethylammonium betaines.

The surfactants may be used singly or in combination of two or more thereof.

A method for preparing the fine particle-dispersed solution can be appropriately selected according to the type of dispersoid.

For example, a method for dispersing the dispersoid by using a general dispersing machine such as a rotary shear type homogenizer, a ball mill a sand mill, a dyno mill or the like having a medium can be mentioned. Moreover, in the case of a dispersoid which dissolves in an organic solvent, the dispersoid may be dispersed in an aqueous medium by using the phase inversion emulsification method. In the phase inversion emulsification method, the material to be dispersed is dissolved in an organic solvent in which the material is soluble, the organic continuous phase (O phase) is neutralized, and then a water medium (W phase) is introduced to perform conversion of resin (so-called phase inversion) from W/O to O/W, induce discontinuous phase formation and disperse in the form of particles in an aqueous medium.

The solvent used in the phase inversion emulsification method is not particularly limited as long as the solvent dissolves the resin, but it is preferable to use a hydrophobic or amphiphilic organic solvent for the purpose of forming droplets.

It is also possible to prepare a fine particle-dispersed solution by carrying out polymerization after forming droplets in an aqueous medium as in emulsion polymerization. Emulsion polymerization is a method for obtaining a fine particle-dispersed solution in which a material is dispersed in an aqueous medium by first mixing a precursor of the material to be dispersed, the aqueous medium, and a polymerization initiator and then stirring or shearing. At this time, an organic solvent or a surfactant may be used as an aid for emulsification. Further, a common apparatus may be used for stirring or shearing, and an example thereof is a common disperser, such as a rotation shear type homogenizer.

When dispersing magnetic bodies, particles with a target diameter of primary particles may be dispersed in an aqueous medium. For the dispersion, for example, a general disperser such as a rotary shear type homogenizer, a ball mill, a sand mill, a dyno mill or the like having media may be used. Since magnetic bodies have a specific gravity higher than that of water and have a high sedimentation rate, it is preferable to immediately proceed to the aggregation step after dispersion.

From the viewpoint of control of aggregation speed and simplicity of coalescence, the number average particle diameter of the dispersoid of the fine particle-dispersed solution is preferably, for example, from 0.01 μm to 1 μm, more preferably from 0.08 μm to 0.8 μm, and even more preferably from 0.1 μm to 0.6 μm.

From the viewpoint of controlling the aggregation speed, the dispersoid in the fine particle-dispersed solution is preferably from 5% by mass to 50% by mass, and more preferably from 10% by mass to 40% by mass based on the total amount of the dispersion.

(b) Aggregation Step

After preparing the fine particle-dispersed solution, one kind of fine particle-dispersed solution or two or more kinds of particle-dispersed solutions are mixed to prepare an agglomerated particle-dispersed solution in which agglomerated particles in which the fine particles are agglomerated are dispersed.

The mixing method is not particularly limited, and the mixing can be performed using a common stirrer.

The aggregation is controlled by the temperature, pH, flocculant and the like of the aggregated particle-dispersed solution, and any method may be used.

The temperature at which the aggregated particles are formed is preferably from a glass transition temperature of the binder resin minus 30.0° C. to a glass transition temperature of the binder resin. From an industrial viewpoint, the time is preferably about 1 min to 120 min.

The flocculant can be exemplified by inorganic metal salts, metal complexes with a valence of two or more, and the like. When a surfactant is used as an auxiliary agent in the fine particle-dispersed solution, it is also effective to use a surfactant of reverse polarity. In particular, when a metal complex is used as the flocculant, the amount of surfactant used is reduced, and the charging characteristics are improved. Examples of inorganic metal salts include metal salts such as sodium chloride, calcium chloride, calcium nitrate, barium chloride, magnesium chloride, magnesium sulfate, zinc chloride, aluminum chloride, aluminum sulfate and the like, and inorganic metal salt polymers such as polyaluminum chloride, polyaluminum hydroxide, calcium polysulfide and the like.

The timing of mixing of the fine particle-dispersed solution is not particularly limited, and the fine particle-dispersed solution may be further added for aggregation after the aggregated particle-dispersed solution has been formed or in the course of formation.

By controlling the addition timing of the fine particle-dispersed solution, it is possible to control the internal structure of the toner particle.

In order to control the degree of aggregation of the above-mentioned magnetic bodies, for example, a pre-aggregation step of adding the flocculant to the magnetic body-dispersed solution and stirring can be performed before aggregating each fine particle-dispersed solution. In the pre-aggregation step, for example, it is preferable to add about 0.3 to 2.0 parts by mass of the flocculant to 100 parts by mass of the magnetic bodies at about 20° C. to 60° C. and stir for about 5 sec to 5 min.

Alternatively, a method is also preferable in which the magnetic body-dispersed solution is added and the aggregation is further performed after the fine particle-dispersed solution other than the magnetic body-dispersed solution is aggregated.

Further, in the aggregation step, a stirring device capable of controlling the stirring speed may be used. The stirring device is not particularly limited, and any general-purpose emulsifying machine and dispersing machine can be used.

For example, a batch-type emulsification machine such as ULTRA TURRAX (manufactured by IKA Corporation), POLYTRON (manufactured by Kinematica Co.), T. K. HOMOMIXER (manufactured by Tokushu Kika Kogyo Co., Ltd.), EBARA MILDER (manufactured by Ebara Corp.), T. K. HOMOMIC LINE FLOW (manufactured by Tokushu Kika Kogyo Co., Ltd.), CREAMIX (manufactured by M Technique Co., Ltd.), PHILMIX (manufactured by Tokushu Kika Kogyo Co., Ltd.), or both batch-type and continuous-type emulsification machine can be used.

The stirring speed may be appropriately adjusted according to the production scale.

In particular, magnetic bodies having a heavy specific gravity are susceptible to the stirring speed. By adjusting the stirring speed and the stirring time, it is possible to control to the desired particle size. When the stirring speed is high, aggregation is likely to be promoted, aggregation of the magnetic bodies proceeds, and a toner with a low brightness is likely to be finally formed.

Further, when the stirring speed is low, the magnetic bodies tend to settle, the aggregated particle dispersion liquid becomes nonuniform, and a difference is easily caused in the introduction amount of the magnetic bodies between the particles.

Meanwhile, it is also possible to control the aggregation state by adding a surfactant.

It is preferable to terminate the aggregation when the aggregated particles reach the target particle size.

The termination of aggregation can be performed by dilution, temperature control, pH control, addition of a chelating agent, addition of a surfactant, and the like, and the addition of a chelating agent is preferable from the viewpoint of production. Furthermore, it is a more preferable method to terminate the aggregation by addition of a chelating agent and adjustment of pH. When the addition of the chelating agent and the adjustment of the pH are used in combination, it is possible to form a toner particle in which the magnetic bodies are slightly aggregated after the subsequent coalescence step.

The pH can be adjusted by known methods using an aqueous solution of sodium hydroxide or the like. It is preferable to adjust the pH to 7.0 to 11.0, and more preferably to 7.5 to 10.0.

As the chelating agent, a water-soluble chelating agent is preferred. Specific examples of the chelating agent include, for example, hydroxycarboxylic acids such as tartaric acid, citric acid, gluconic acid and the like, iminodiacid (IDA), nitrilotriacetic acid (NTA), ethylenediaminetetraacetic acid (EDTA) and the like.

The addition amount of the chelating agent is, for example, preferably from 10.0 parts by mass to 100.0 parts by mass, and more preferably from 20.0 parts by mass to 70.0 parts by mass with respect to 100 parts by mass of the magnetic bodies.

(c) Coalescence Step

After forming the aggregated particles, the particles are heated to form toner particles by melting and coalescence.

The heating temperature is preferably equal to or higher than the glass transition temperature of the binder resin. For example, 45° C. to 130° C. Industrially, the time is preferably about 1 min to 900 min, and more preferably 5 min to 500 min.

Further, a toner particle having a core/shell structure may be also formed by heating and coalescing the aggregated particles, then mixing the fine particle-dispersed solution such as a resin, and further performing the step (b) of forming the aggregated particles and the step (c) of melting and coalescing.

Further, after the coalescence step, the dispersion state of the crystalline polyester can be controlled by rapid cooling to a temperature equal to or lower than the glass transition temperature of the binder resin and solidification by a heat exchanger or a method such as mixing with cold water, thereby forming toner particles tin which the crystalline polyester is unevenly distributed.

Preferably, the toner particle-dispersed solution is cooled to a temperature of 40° C. or less at a temperature decrease rate of 10° C./min or more, more preferably at a temperature decrease rate of 100° C./min or more, and even more preferably at a temperature decrease rate of 200° C./min or more. The upper limit is preferably about 1000° C./minute or less.

Then, in any of the steps after the coalescence step, annealing may be performed by heating the toner particles for the purpose of increasing the degree of crystallization of the crystalline polyester.

(d) Washing and Drying Step

Well-known washing method, solid-liquid separation method, and drying method may be used without particular limitation.

However, in the washing step, it is preferable to carry out substitution washing with ion exchange water sufficiently from the viewpoint of charging performance. In the solid-liquid separation step, suction filtration, pressure filtration and the like are preferably performed from the viewpoint of productivity. In the drying step, it is preferable to perform freeze drying, flash jet drying, fluid drying, vibration type fluid drying and the like from the viewpoint of productivity.

The magnetic toner particles may be mixed, if necessary, with an external additive to make the magnetic toner in order to improve the flowability and/or the charging performance of the toner. A known device, for example, a Henschel mixer may be used for mixing of the external additive.

As the external additive, inorganic fine particles having a number average particle diameter of primary particles of from 4 nm to 80 nm are preferable, and inorganic fine particles having a number average particle diameter of primary particles of from 6 nm to 40 nm are more preferable.

The inorganic fine particles can further improve the charging performance and environmental stability of the toner when subjected to a hydrophobization treatment. Examples of treatment agents to be used for the hydrophobization treatment include silicone varnish, various modified silicone varnishes, silicone oils, various modified silicone oils, silane compounds, silane coupling agents, other organic boron compounds, organic titanium compounds and the like. The treatment agents may be used singly or in combination of two or more thereof.

The number average particle diameter of the primary particles of the inorganic fine particles may be calculated using an image of the toner captured by a scanning electron microscope (SEM).

Examples of the inorganic fine particles include silica fine particles, titanium oxide fine particles, alumina fine particles and the like. As the silica fine particles, for example, both dry silica such as silica or fumed silica produced by so-called dry method and generated by vapor phase oxidation of a silicon halide, and so-called wet silica produced from water glass and the like can be used.

However, dry silica having fewer silanol groups on the surface and inside the silica fine particles and having less production residues such as $Na_2O$ and $SO_3^{2-}$ is preferable.

In the production step of dry silica, it is also possible to obtain composite fine particles of silica and other metal oxides, for example, by using other metal halides such as aluminum chloride, titanium chloride and the like together with the silicon halide in the production process, and the concept of dry silica is inclusive of such particles.

The amount of the inorganic fine particles is preferably from 0.1 parts by mass to 3.0 parts by mass with respect to 100 parts by mass of the toner particles. The amount of the inorganic fine particles may be quantitatively determined from a calibration curve prepared from a standard sample using a fluorescent X-ray analyzer.

The magnetic toner may include other additives as long as the effects of the present invention are not adversely affected.

Examples of other additives include lubricant powder such as fluorocarbon resin powder, zinc stearate powder, polyvinylidene fluoride powder and the like; abrasives such as cerium oxide powder, boron carbide powder, strontium titanate powder and the like; anti-caking agents and the like. Other additives can also be used after the surface thereof is hydrophobized.

The volume average particle diameter (Dv) of the magnetic toner is preferably from 3.0 μm to 8.0 μm, and more preferably from 5.0 μm to 7.0 μm.

By setting the volume average particle diameter (Dv) of the toner within the above range, it is possible to sufficiently satisfy the dot reproducibility while improving toner handleability.

Further, the ratio (Dv/Dn) of the volume average particle diameter (Dv) to the number average particle diameter (Dn) of the magnetic toner is preferably less than 1.25.

The average circularity of the magnetic toner is preferably from 0.960 to 1.000, and more preferably from 0.970 to 0.990.

When the average circularity is in the above range, even in a system with a strong shear force, such as a one-component contact development system, the toner is unlikely to be compacted and the flowability of the toner is easily maintained. As a result, when performing a large number of image outputs, it is possible to further suppress the decrease in image density in the second half.

The average degree of circularity may be controlled by a method generally used at the time of toner production. For example, in the emulsion aggregation method, it is preferable to control the duration of the coalescence step and the amount of surfactant added.

In the one-component contact development system, a toner bearing member and an electrostatic latent image bearing member are arranged in contact (contact arrangement) with each other, and these bearing members carry the toner by rotating. A strong shear force occurs in the contact portion between the toner bearing member and the electrostatic latent image bearing member. Therefore, in order to obtain a high quality image, it is preferable that the toner have high durability and high flowability.

Meanwhile, as the development system, the one-component development system makes it possible to miniaturize the cartridge in which the developer is stored, as compared with the two-component development system using a carrier.

In addition, the contact development system makes it possible to obtain high quality images with little toner scattering. That is, the one-component contact development system demonstrating the abovementioned effects in combination makes it possible to achieve both downsizing of the developing device and high image quality.

Hereinafter, the one-component contact development system will be described in detail with reference to the drawings.

Figure 2:
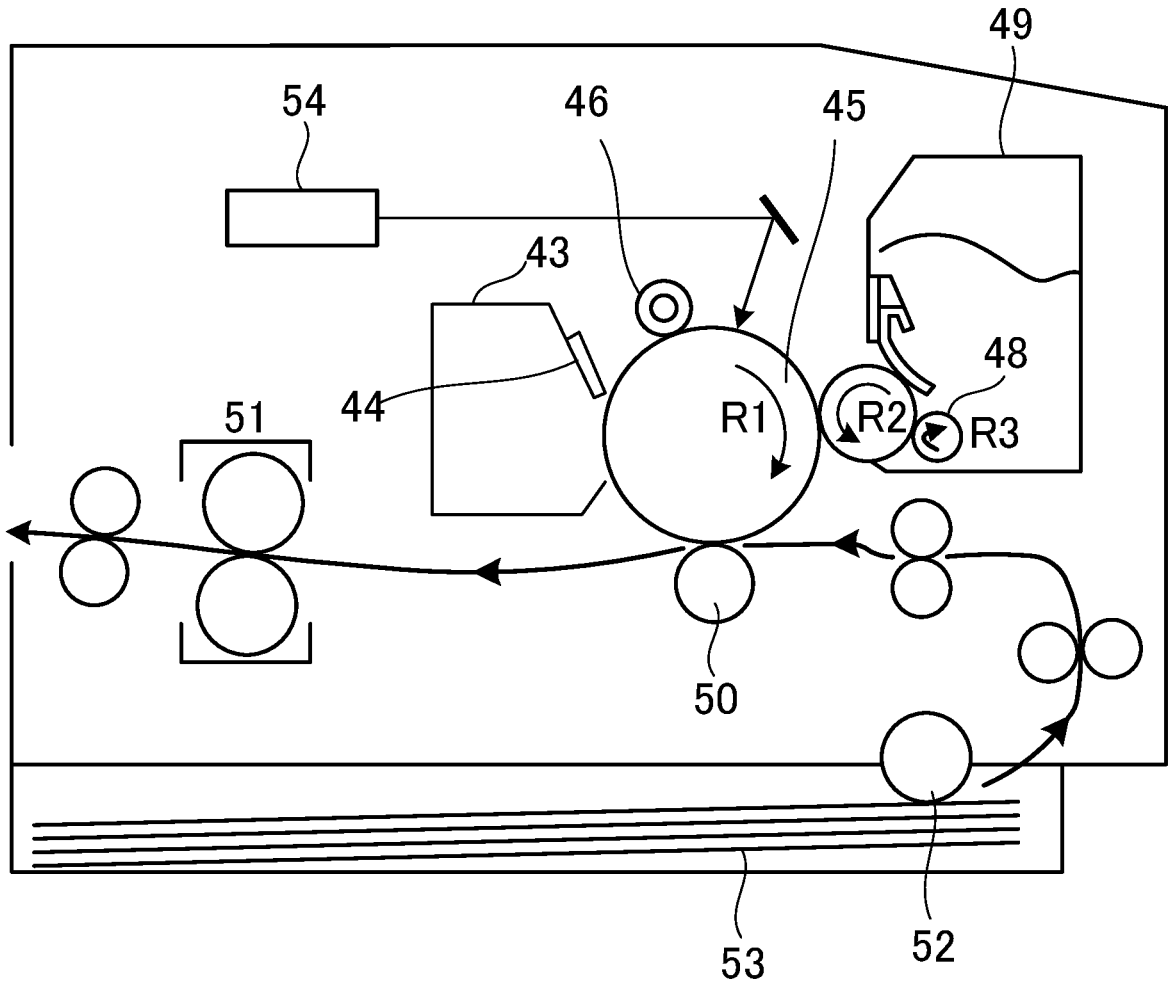
FIG. 2 is a schematic cross-sectional view of an image forming apparatus of a one-component contact development system.

FIG. 1 is a schematic cross-sectional view showing an example of a developing device. FIG. 2 is a schematic cross-sectional view showing an example of a one-component contact development type image forming apparatus.

In FIGS. 1 and 2, an electrostatic latent image bearing member 45 on which an electrostatic latent image is formed is rotated in the direction of an arrow R1. The toner bearing member 47 rotates in the direction of an arrow R2 to transport a toner 57 to a development area where the toner bearing member 47 and the electrostatic latent image bearing member 45 are opposed to each other. Further, a toner supply member 48 is in contact with the toner bearing member 47, and the toner 57 is supplied to the surface of the toner bearing member 47 by rotating the toner supply member in the direction of an arrow R3. Further, the toner 57 is stirred by a stirring member 58.

A charging member (charging roller) 46, a transfer member (transfer roller) 50, a cleaner container 43, a cleaning blade 44, a fixing device 51, a pickup roller 52 and the like are provided around the electrostatic latent image bearing member 45. The electrostatic latent image bearing member 45 is charged by the charging roller 46. Then, the electrostatic latent image bearing member 45 is irradiated with laser light by a laser generator 54 to perform exposure, thereby forming an electrostatic latent image corresponding to the target image.

The electrostatic latent image on the electrostatic latent image bearing member 45 is developed by the toner 57 in the developing device 49 to obtain a toner image. The toner image is transferred onto a transfer material (paper) 53 by the transfer member (transfer roller) 50 which is in contact with the electrostatic latent image bearing member 45, with the transfer material being interposed therebetween. Transfer of the toner image to the transfer material may be performed via an intermediate transfer member. The transfer material (paper) 53 bearing the toner image is conveyed to the fixing device 51 and the toner image is fixed on the transfer material (paper) 53. Further, the toner 57 left partially on the electrostatic latent image bearing member 45 is scraped off by the cleaning blade 44 and stored in the cleaner container 43.

In addition, it is preferable that the toner layer thickness on the toner bearing member be regulated by the toner regulating member (reference numeral 55 in FIG. 1) being in contact with the toner bearing member with the toner being interposed therebetween. By doing this, it is possible to obtain high image quality without regulatory failure. A regulating blade is generally used as a toner regulating member that is in contact with the toner bearing member.

The base which is the upper side of the regulating blade is fixedly held on the developing device side, and the lower side may be bent in the forward or reverse direction of the toner bearing member against the elastic force of the blade to be brought into contact with the toner bearing member surface with a suitable elastic pressing force.

For example, as shown in FIG. 1, the toner regulating member 55 may be fixedly attached to the developing device by sandwiching and fastening a free end on one side of the toner regulating member 55 between two fixing members (for example, metal elastic bodies, reference numeral 56 in FIG. 1).

Methods for measuring various physical property values according to the present invention are described hereinbelow.

Method for Measuring Powder Dynamic Viscoelasticity of Magnetic Toner

The measurement is performed using a dynamic viscoelasticity measuring device DMA 8000 (manufactured by Perkin Elmer Inc.).

Measuring jig: material pocket (P/N: N533-0322)

A total of 80 mg of the magnetic toner is held in the material pocket, and the material pocket is attached to a single cantilever and secured by tightening a screw with a torque wrench.

Measurement is performed using dedicated software "DMA Control Software" (manufactured by Perkin Elmer Inc.). The measurement conditions are as follows.

Oven: Standard Air Oven
Measurement type: temperature scan
DMA condition: single frequency/strain (G)
Frequency: 1 Hz
Strain: 0.05 mm
Starting temperature: 25° C.
End temperature: 180° C.
Scanning speed: 20° C./min
Deformation mode: single cantilever (B)
Cross section: rectangular (R)
Specimen size (length): 17.5 mm
Specimen size (width): 7.5 mm
Specimen size (thickness): 1.5 mm From the curve of storage elastic modulus E' obtained by the measurement, E' (40) and E'(85) are read, and the value of [E'(40)−E'(85)]×100/E'(40) is calculated.

Method for Measuring Volume Average Particle Diameter (Dv) and Number Average Particle Diameter (Dn) of Magnetic Toner The volume average particle diameter (Dv) and number average particle diameter (Dn) of the magnetic toner are calculated in the following manner.

A precision particle diameter distribution measuring apparatus "Coulter Counter Multisizer 3" (registered trademark, manufactured by Beckman Coulter, Inc.) equipped with a 100-μm aperture tube having a pore size and based on a pore electric resistance method is used as a measuring device. The dedicated software "Beckman Coulter Multisizer 3 Version 3.51" (manufactured by Beckman Coulter, Inc.) provided with the device is used for setting measurement conditions and performing measurement data analysis. The measurement is performed with 25,000 effective measurement channels.

A solution prepared by dissolving special grade sodium chloride in ion exchange water to a concentration of about 1% by mass, for example, "ISOTON II" (manufactured by Beckman Coulter, Inc.), can be used as the electrolytic aqueous solution.

The dedicated software is set up in the following manner before the measurement and analysis.

The total count number in a control mode is set to 50,000 particles on a "CHANGE STANDARD MEASUREMENT METHOD (SOM)" screen in the dedicated software, the number of measurements is set to 1, and a value obtained using "standard particles 10.0 μm" (manufactured by Beckman Coulter, Inc.) is set as a Kd value. The threshold and the noise level are automatically set by pressing the "MEASUREMENT BUTTON OF THE THRESHOLD/NOISE LEVEL". Further, the current is set to 1600 μA, the gain is set to 2, the electrolytic solution is set to ISOTON II, and "FLUSH OF APERTURE TUBE AFTER MEASUREMENT" is checked.

In the "PULSE TO PARTICLE DIAMETER CONVERSION SETTING" screen of the dedicated software, the bin interval is set to a logarithmic particle diameter, the particle diameter bin is set to a 256-particle diameter bin, and a particle diameter range is set from 2 μm to 60 μm.

A specific measurement method is described hereinbelow.

(1) Approximately 200 mL of the electrolytic aqueous solution is placed in a glass 250 mL round-bottom beaker dedicated to Multisizer 3, the beaker is set in a sample stand, and stirring with a stirrer rod is carried out counterclockwise at 24 rev/sec. Dirt and air bubbles in the aperture tube are removed by the "FLUSH OF APERTURE TUBE" function of the dedicated software.

(2) Approximately 30 ml of the electrolytic aqueous solution is placed in a glass 100 mL flat-bottom beaker. Then, about 0.3 mL of a diluted solution obtained by 3-fold mass dilution of "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with ion exchange water is added.

(3) An ultrasonic disperser "Ultrasonic Dispersion System Tetora 150" (manufactured by Nikkaki Bios Co., Ltd.) with an electrical output of 120 W in which two oscillators with an oscillation frequency of 50 kHz are built in with a phase shift of 180 degrees is prepared. About 3.3 L of ion exchange water is placed in the water tank of the ultrasonic disperser, and about 2 mL of CONTAMINON N is added to the water tank.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) About 10 mg of the magnetic toner is added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 sec. In the ultrasonic dispersion, the water temperature in the water tank is appropriately adjusted to a temperature from 10° C. to 40° C.

(6) The electrolytic aqueous solution of (5) hereinabove in which the toner is dispersed is dropped by using a pipette into the round bottom beaker of (1) hereinabove which has been set in the sample stand, and the measurement concentration is adjusted to be about 5%. Then, measurement is conducted until the number of particles to be measured reaches 50,000.

(7) The measurement data are analyzed with the dedicated software provided with the device, and the volume average particle diameter (Dv) and number average particle diameter (Dn) are calculated. The "50% D diameter" on the "ANALYSIS/VOLUME STATISTICAL VALUE (ARITHMETIC MEAN)" screen obtained when the graph/(% by volume) is set in the dedicated software is taken as the volume average particle diameter (Dv), and the "ARITHMETIC DIAMETER" on the "ANALYSIS/NUMBER STATISTICAL VALUE (ARITHMETIC MEAN)" screen obtained when the graph/(% by number) is set in the dedicated software is taken as the number average particle diameter (Dn).

Method for Measuring Average Brightness, Brightness Dispersion Value, Variation Coefficient Thereof, and Average Circularity of Magnetic Toner The average brightness, brightness dispersion value, variation coefficient thereof, and average circularity of the magnetic toner are measured with a flow-type particle image analyzer "FPIA-3000" (manufactured by Sysmex Corp.) under the measurement and analysis conditions used at the time of calibration operation.

The specific measurement method is described hereinbelow.

First, about 20 mL of ion exchange water from which solid impurities and the like have been removed in advance is placed in a glass container. About 0.2 mL of a diluted solution prepared by diluting "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with about three-fold mass of ion exchange water is added as a dispersing agent thereto. Further, about 0.02 g of a measurement sample is added, and dispersion treatment is performed for 2 min using an ultrasonic wave disperser to obtain a dispersion solution for measurement. At that time, the dispersion solution is suitably cooled to a temperature of from 10° C. to 40° C. As the ultrasonic wave disperser, a table-top type ultrasonic cleaner disperser ("VS-150" (manufactured by VELVO-CLEAR Co.)) having an oscillation frequency of 50 kHz and an electric output of 150 W is used, a predetermined amount of ion exchange water is placed into a water tank, and about 2 mL of the CONTAMINON N is added to the water tank.

For measurement, the flow type particle image analyzer equipped with "LUCPLFLN" (magnification 20×, numerical aperture 0.40) as the objective lens is used, and a particle sheath "PSE-900A" (manufactured by Sysmex Corporation) is used as a sheath liquid. The dispersion solution prepared according to the procedure is introduced into the flow type particle image analyzer, and 2,000 magnetic toner particles are measured in an HPF measurement mode and a total count mode. From the results, the average brightness, brightness dispersion value, and average circularity of the magnetic toner are calculated.

The average brightness at Dn of the magnetic toner is a value obtained by calculation of the average brightness in which the circle-equivalent diameter of the flow type particle image analyzer is limited to the range from Dn−0.500 (μm) to Dn+0.500 (μm) with respect to the result of the number average particle diameter (Dn) of the magnetic toner.

CV1 is a value obtained by calculation of the variation coefficient of brightness dispersion value in which the circle-equivalent diameter of the flow type particle image analyzer is limited to the range from Dn−0.500 (μm) to Dn+0.500 (μm) with respect to the result of the number average particle diameter (Dn) of the magnetic toner in the measurement result of the brightness dispersion value.

CV2 is a value obtained by calculation of the variation coefficient of brightness dispersion value in which the circle-equivalent diameter of the flow type particle image analyzer is limited to the range from Dn−1.500 (μm) to Dn−0.500 (μm) with respect to the result of the number average particle diameter (Dn) of the magnetic toner in the measurement result of the brightness dispersion value.

In the measurement, automatic focusing is performed using standard latex particles (for example, "RESEARCH AND TEST PARTICLES Latex Microsphere Suspensions 5100A" manufactured by Duke Scientific Inc. which are diluted with ion exchange water) before the start of the measurement. After that, it is preferable to perform focusing every 2 h from the start of the measurement.

The flow type particle image analyzer used in this case was calibrated by Sysmex Corporation and provided with a calibration certificate issued by Sysmex Corporation.

The measurement is performed under the measurement and analysis conditions at the time of receiving the calibration certification, except that the analysis particle diameter is limited to the circle-equivalent diameter of 1.977 μm or more to less than 39.54 μm.

Method for Measuring Peak Temperature (or Melting Point) of Maximum Endothermic Peak The peak temperature of the maximum endothermic peak of a material such as crystalline polyester is measured under the following conditions using a differential scanning calorimeter (DSC) Q2000 (manufactured by TA Instruments).

Temperature rise rate: 10° C./min

Measurement start temperature: 20° C.

Measurement end temperature: 180° C.

The melting points of indium and zinc are used for temperature correction of the device detection unit, and the melting heat of indium is used for correction of heat quantity.

Specifically, about 5 mg of a sample is precisely weighed, placed in an aluminum pan, and measured once. An empty aluminum pan is used as a reference. The peak temperature of the maximum endothermic peak at that time is taken as the melting point.

Method for Measuring Glass Transition Temperature (Tg)

The glass transition temperature of the magnetic toner or resin can be determined from a reversing heat flow curve at the time of temperature rise obtained by differential scanning calorimetry when measuring the peak temperature of the maximum endothermic peak. The glass transition temperature is a temperature (° C.) at the point where a straight line, which is equidistant in the ordinate direction from the straight line obtained by extending the baseline before and after a specific heat change, and the curve of the stepwise change portion of the glass transition in the reversing heat flow curve cross each other.

Method for Measuring Number Average Molecular Weight (Mn), Weight Average Molecular Weight (Mw) and Peak Molecular Weight (Mp) of Resin etc.

The number average molecular weight (Mn), weight average molecular weight (Mw) and peak molecular weight (Mp) of the resin and other materials are measured using gel permeation chromatography (GPC) in the following manner.

(1) Preparation of Measurement Sample

A sample and tetrahydrofuran (THF) are mixed at a concentration of 5.0 mg/mL. The mixture is allowed to stand at room temperature for 5 h to 6 h and then shaken thoroughly, and the sample and THF are mixed well till the sample aggregates are loosened. The components are thereafter allowed to stand for 12 h or more at room temperature. At this time, the time from the start of mixing of the sample and THF to the end of standing is set to be 72 h or more to obtain tetrahydrofuran (THF) soluble matter of the sample.

Subsequent filtration through a solvent-resistant membrane filter (pore size: 0.45 μm to 0.50 μm, Myshory Disc H-25-2 (manufactured by Tosoh Corporation)) produces a sample solution.

(2) Measurement of Sample

Measurement is performed under the following conditions using the obtained sample solution.

Device: high-speed GPC device LC-GPC 150C (manufactured by Waters Co.)

Column: 7 series of Shodex GPC KF-801, 802, 803, 804, 805, 806, 807 (manufactured by Showa Denko K.K.)

Mobile phase: THF

Flow rate: 1.0 mL/min

Column temperature: 40° C.

Sample injection volume: 100 μL

Detector: RI (refractive index) detector

When measuring the molecular weight of the sample, the molecular weight distribution of the sample is calculated from the relationship between the logarithmic value of the calibration curve prepared using several types of monodispersed polystyrene standard samples and the count number.

Samples produced by Pressure Chemical Co. or Toyo Soda Industry Co., Ltd. and having a molecular weight of $6.0\times10^2$, $2.1\times10^3$, $4.0\times10^3$, $1.75\times10^4$, $5.1\times10^4$, $1\times10^5$, $3.9\times10^5$, $8.6\times10^5$, $2.0\times10^6$, and $4.48\times10^6$ are used as standard polystyrene samples for preparation of the calibration curve.

Method for Measuring Particle Diameter of Dispersion in Fine Particle-Dispersed Solution The particle diameter of the dispersion of each of the fine particle-dispersed solutions such as the resin particle-dispersed solution and the magnetic body-dispersed solution is measured using a laser diffraction/scattering particle size distribution measuring apparatus. Specifically, the measurement is performed in accordance with JIS Z 8825-1 (2001).

As a measuring apparatus, a laser diffraction/scattering type particle size distribution measuring apparatus "LA-920" (manufactured by Horiba, Ltd.) is used.

For setting of measurement conditions and analysis of measurement data, dedicated software "HORIBA LA-920 for Windows (registered trademark) WET (LA-920) Ver. 2.02" provided with the LA-920 is used. In addition, ion exchange water from which solid impurities and the like have been removed in advance is used as a measurement solvent. The measurement procedure is as follows.

(1) A batch cell holder is attached to the LA-920.

(2) A predetermined amount of ion exchange water is poured into a batch cell, and the batch cell is set in the batch cell holder.

(3) The inside of the batch cell is stirred using a dedicated stirrer tip.

(4) The "REFRACTIVE INDEX" button on the "DISPLAY CONDITION SETTING" screen is pushed, and the relative refractive index is set to a value corresponding to the fine particle.

(5) On the "DISPLAY CONDITION SETTING" screen, the particle diameter standard is set as the volume standard.

(6) After performing warm-up operation for 1 h or more, adjustment of the optical axis, fine adjustment of the optical axis, and blank measurement are performed.

(7) A total of 3 mL of the fine particle-dispersed solution is placed in a 100 mL flat bottom beaker made of glass. Then, 57 ml of ion exchange water is added to dilute the fine particle-dispersed solution. Then, about 0.3 mL of a diluted solution prepared by diluting "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with about three-fold mass of ion exchange water is added as a dispersing agent thereto.

(8) An ultrasonic disperser "Ultrasonic Dispersion System Tetora 150" (manufactured by Nikkaki Bios Co., Ltd.) with an electrical output of 120 W in which two oscillators with an oscillation frequency of 50 kHz are built in with a phase shift of 180 degrees is prepared. About 3.3 L of ion exchange water is placed in the water tank of the ultrasonic disperser, and about 2 mL of CONTAMINON N is added to the water tank.

(9) The beaker of (7) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(10) The ultrasonic dispersion process is further continued for 60 sec. In the ultrasonic dispersion, the water temperature in the water tank is appropriately adjusted to a temperature from 10° C. to 40° C.

(11) The fine particle-dispersed solution prepared in (10) hereinabove is added little by little to the batch cell, while taking care not to cause air bubbles, so that the transmittance of the tungsten lamp is adjusted to 90% to 95%. Then, the particle size distribution is measured. Based on the volume-based particle size distribution data thus obtained, the particle size of the dispersion in the fine particle-dispersed solution is calculated.

Method for Calculating Occupied Area Ratio of Magnetic Bodies in Magnetic Toner Particle and Variation Coefficient (CV3) Thereof The occupied area ratio of the magnetic bodies in the magnetic toner particle and the variation coefficient (CV3) thereof are calculated as follows.

First, a transmission electron microscope (TEM) is used to acquire an image of the cross section of the magnetic toner particle. The obtained cross-sectional image is used to obtain a frequency histogram of the occupied area ratio of the magnetic bodies in each divided grid on the basis of a division method.

Then, the variation coefficient of the occupancy area ratio of each obtained division grid is determined and taken as the variation coefficient (CV3) of the occupancy area ratio.

Specifically, first, magnetic toner is compression molded into a tablet. The tablet is obtained by filling a tablet former having a diameter of 8 mm with 100 mg of the magnetic toner, applying a force of 35 kN and allowing to stand for 1 min.

The obtained tablet is cut with an ultrasonic ultramicrotome (Leica Co., Ltd., UC7) to obtain a thin sample having a thickness of 250 nm.

A STEM image of the thin sample obtained is captured using a transmission electron microscope (JEOL Co., JEM 2800).

The probe size used for capturing the STEM image is 1.0 nm, and the image size is 1024×1024 pixels. At this time, by adjusting the Contrast of the bright field image Detector Control panel to 1425, the Brightness to 3750, the Contrast to the Image Control panel to 0.0, the Brightness to 0.5, and the Gammma to 1.00, an image can be captured with only the magnetic body portion being dark. By the setting, a STEM image suitable for image processing can be obtained.

The obtained STEM image is digitized using an image processing apparatus (Nireco, Inc., LUZEX AP).

Specifically, a frequency histogram of the occupied area ratio of the magnetic body in a square grid of 0.8 μm on one side is obtained by the division method. At this time, the grade interval of the histogram is 5%.

Further, the variation coefficient is obtained from the obtained occupied area ratio of each section grid and taken as the variation coefficient CV3 of the occupied area ratio.

Method for Calculating Number Average Diameter of Domains of Crystalline Polyester The magnetic toner is embedded in a visible light-curable embedding resin (D-800, manufactured by Nisshin EM Co., Ltd.), cut with an ultrasonic ultramicrotome (Leica Co., Ltd., UC7) into thin pieces having a thickness of 250 nm and Ru-stained with a vacuum staining device (manufactured by Filgen, Inc.).

Thereafter, using a transmission electron microscope (H7500, manufactured by Hitachi High-Technologies Corporation), cross-sectional observation of the obtained magnetic toner particles is performed at an acceleration voltage of 120 kV.

As for the cross section of the magnetic toner particles to be observed, ten particles within ±2.0 μm from the number average particle diameter of the magnetic toner particles are selected and images thereof are captured to obtain cross-sectional images.

In addition, compared with the amorphous resin and magnetic bodies, staining of the crystalline polyester with Ru does not advance, and the crystalline polyester looks from black to gray in this cross-sectional image.

In the cross-sectional image, 30 domains of the crystalline polyester having a major axis of 20 nm or more are randomly selected, the average value of the major and minor axes is taken as the domain diameter, and the average value for 30 domains is taken as the number average diameter of crystalline polyester domains. The selection of domains may not be in the same magnetic toner particle.

Method for Calculating Occupied Area Ratio of Crystalline Polyester in Magnetic Toner Particle and Variation Coefficient (CV4) Thereof The occupied area ratio of the crystalline polyester in the magnetic toner particle and the variation coefficient (CV4) thereof are calculated as follows.

First, a transmission electron microscope (TEM) is used to acquire an image of the cross section of the magnetic toner particle. The obtained cross-sectional image is used to obtain a frequency histogram of the occupied area ratio of the crystalline polyester in each divided grid on the basis of a division method.

Then, the variation coefficient of the occupied area ratio of each obtained division grid is determined and taken as the variation coefficient (CV4) of the occupied area ratio.

Specifically, first, magnetic toner is compression molded into a tablet. The tablet is obtained by filling a tablet former having a diameter of 8 mm with 100 mg of the magnetic toner, applying a force of 35 kN and allowing to stand for 1 min.

The obtained tablet is cut with an ultrasonic ultramicrotome (Leica Co., Ltd., UC7) to obtain a thin sample having a thickness of 250 nm and Ru-stained with a vacuum staining device (manufactured by Filgen, Inc.).

A STEM image of the thin sample observed in a bright field by using a transmission electron microscope (JEOL Co., JEM 2800) is captured. At this time, the crystalline polyester looks from black to gray.

The probe size used for capturing the STEM image is 1.0 nm, and the image size is 1024×1024 pixels. At this time, by adjusting the Contrast of the bright field image Detector Control panel to 1425, the Brightness to 3750, the Contrast to the Image Control panel to 0.0, the Brightness to 0.5, and the Gammma to 1.00, an image can be captured with only the magnetic body portion being dark. By the setting, a STEM image suitable for image processing can be obtained.

Using the image processing software imageJ, an image 1 is obtained in which the image is binarized so that the magnetic body portion of the obtained STEM image is black and the other part is white. Thereafter, in the same image processing software, an image 2 of a differential portion obtained by subtracting the binarized image 1 from the original STEM image is obtained.

Regarding the image 2, using the image processing software, a binarized image 3 is obtained such that the domains of the crystalline polyester are black and the other regions are white.

The obtained binarized image 3 is digitized using an image processing apparatus (Nireco, Inc., LUZEX AP).

Specifically, a frequency histogram of the occupied area ratio of crystalline polyester in a square grid having a side of 0.8 μm is obtained by the division method. At this time, the class interval of the histogram is 5%.

Further, the variation coefficient is obtained from the occupied area ratio of each obtained section grid and taken as the variation coefficient CV4 of the occupied area ratio.

EXAMPLES

The present invention will be described hereinbelow in greater detail by way of the following Examples and Comparative Examples, but the present invention is not limited thereto. In the Examples and Comparative Examples, the number of parts and are all based on mass unless stated otherwise.

Production Example of Amorphous Polyester A1

| | |
|---|---|
| Terephthalic acid | 48.0 parts |
| Dodecenyl succinic acid | 17.0 parts |
| Trimellitic acid | 10.2 parts |
| Bisphenol A ethylene oxide (2 mole) adduct | 80.0 parts |
| Bisphenol A propylene oxide (2 mole) adduct | 74.0 parts |
| Dibutyltin oxide | 0.1 parts |

The above materials were placed in a heat-dried two-necked flask, nitrogen gas was introduced into the vessel to maintain the inert atmosphere, and the temperature was raised under stirring. Thereafter, a polycondensation reaction was carried out at 150° C. to 230° C. for about 13 h, and the pressure was thereafter gradually reduced at 210° C. to 250° C. to obtain an amorphous polyester A1.

The number average molecular weight (Mn) of the amorphous polyester A1 was 21200, the weight average molecular weight (Mw) was 98,000, and the glass transition temperature (Tg) was 58.3° C.

The content ratio (denoted as X in Table 1) of monomer units derived from an aromatic diol and monomer units derived from an aromatic dicarboxylic acid based on all monomer units constituting the amorphous polyester A1 was 87.0 mol %.

Production Examples of Amorphous Polyesters A2 and A3

Amorphous polyesters A2 and A3 were obtained in the same manner as in Production Example of Amorphous Polyester A1, except that the formulation was changed as shown in Table 1.

The content ratio of monomer units derived from an aromatic diol and monomer units derived from an aromatic dicarboxylic acid based on all monomer units constituting the respective amorphous polyester was 80.0 mol % for the amorphous polyester A2 and 85.2 mol % for the amorphous polyester A3.

TABLE 1

| Resin No. | Terephthalic acid (parts) | Isophthalic acid (parts) | Sebacic acid (parts) | Dodecenyl succinic acid (parts) | Trimellitic acid (parts) | BPA-EO (parts) | BPA-PO (parts) | Molecular weight (Mw) | X (mol %) |
|---|---|---|---|---|---|---|---|---|---|
| A1 | 48.0 | 0.0 | 0.0 | 17.0 | 10.2 | 80.0 | 74.0 | 98000 | 87.0 |
| A2 | 30.0 | 10.0 | 15.0 | 20.0 | 6.9 | 70.0 | 90.0 | 85000 | 80.0 |
| A3 | 40.0 | 0.0 | 0.0 | 11.5 | 14.5 | 70.0 | 70.0 | 105900 | 85.2 |

In the table, the abbreviations are as follows.
BPA-EO: bisphenol A ethylene oxide (2 mole) adduct
BPA-PO: bisphenol A propylene oxide (2 mole) adduct Production Example of Crystalline Polyester B1

| | |
|---|---|
| 1,10-Decanedicarboxylic acid | 230.0 parts |
| 1,9-Nonanediol | 168.0 parts |
| Dibutyltin oxide | 0.1 part |

The above materials were placed in a heat-dried two-necked flask, nitrogen gas was introduced into the vessel to maintain the inert atmosphere, and the temperature was raised under stirring. Then, stirring was performed at 170° C. for 6 h. Thereafter, the temperature was gradually raised to 230° C. under reduced pressure while the stirring was continued, and the temperature was further maintained for 3 h. A crystalline polyester B1 was synthesized by cooling with air and stopping the reaction once a viscous state was reached. The weight average molecular weight (Mw) of the crystalline polyester B1 was 36700, and the melting point was 73.0° C.

Production Examples of Crystalline Polyesters B2 to B5

Crystalline Polyesters B2 to B5 were obtained in the same manner as in Production Example of Crystalline Polyester B1, except that the formulation was changed as shown in Table 2.

TABLE 2

| Resin No. | 1,9-Nonanediol (parts) | 1,2-Ethanediol (parts) | 1,6-Hexanediol (parts) | 1,12-Dodecanediol (parts) | 1,10-Decanedicarboxylic acid (parts) | 1,12-Dodecanedicarboxylic acid (parts) | Molecular weight (Mw) | Melting point (° C.) |
|---|---|---|---|---|---|---|---|---|
| B1 | 168.0 | 0.0 | 0.0 | 0.0 | 230.0 | 0.0 | 36700 | 73.0 |
| B2 | 0.0 | 0.0 | 124.0 | 0.0 | 230.0 | 0.0 | 28500 | 71.8 |
| B3 | 0.0 | 65.0 | 0.0 | 0.0 | 230.0 | 0.0 | 24200 | 69.5 |
| B4 | 0.0 | 0.0 | 0.0 | 212.0 | 230.0 | 0.0 | 25100 | 82.0 |
| B5 | 0.0 | 0.0 | 0.0 | 212.0 | 0.0 | 258.0 | 32500 | 85.0 |

Production Example of Resin Particle-Dispersed Solution D-1

A total of 100.0 parts of ethyl acetate, 30.0 parts of the polyester A1, 0.3 parts of 0.1 mol/L sodium hydroxide, and 0.2 parts of an anionic surfactant (Neogen RK, manufactured by Daiichi Kogyo Seiyaku Co., Ltd.) were placed in a beaker equipped with a stirrer, heating to 60.0° C. was performed, and stirring was continued until complete dissolution to prepare a resin solution D-1.

A total of 90.0 parts of ion exchange water was gradually added while further stirring the resin solution D-1, phase inversion emulsification was carried out, and solvent removal was performed to obtain a resin particle-dispersed solution D-1 (solid fraction concentration: 25.0% by mass).

The volume average particle diameter of the resin particles in the resin particle-dispersed solution D-1 was 0.19 μm.

Production Examples of Resin Particle-Dispersed Solutions D-2 to D-10

Resin particle-dispersed solutions D-2 to D-10 were obtained in the same manner as in Production Example of Particle-Dispersed Solution D-1, except that the formulation was changed as shown in Table 3. The formulations and physical properties are shown in Table 3.

TABLE 3

| Resin Particle-dispersed solution | Polyester resin No. | Polyester resin Parts | Ethyl acetate Parts | Particle diameter (μm) |
|---|---|---|---|---|
| D-1 | A1 | 30.0 | 100.0 | 0.19 |
| D-2 | A2 | 30.0 | 100.0 | 0.18 |
| D-3 | A3 | 30.0 | 100.0 | 0.22 |
| D-4 | B1 | 30.0 | 100.0 | 0.19 |
| D-5 | B2 | 30.0 | 100.0 | 0.18 |
| D-6 | B3 | 30.0 | 100.0 | 0.16 |
| D-7 | B4 | 30.0 | 100.0 | 0.21 |
| D-8 | B2 | 30.0 | 70.0 | 0.28 |
| D-9 | B2 | 30.0 | 50.0 | 0.31 |
| D-10 | B5 | 30.0 | 100.0 | 0.21 |

Production Example of Resin Particle-Dispersed Solution D-11

| | |
|---|---|
| Styrene | 79.0 parts |
| n-Butyl acrylate | 19.0 parts |
| β-Carboxyethyl acrylate | 2.0 parts |

-continued

| | |
|---|---|
| 1,6-Hexanediol diacrylate | 0.4 parts |
| Dodecanethiol (Wako Pure Chemical Industries) | 0.7 part |

The above materials were loaded into a flask and mixed and dissolved to obtain a solution.

The obtained solution was dispersed and emulsified in an aqueous medium in which 1.0 part of an anionic surfactant (Neogen RK, manufactured by Daiichi Kogyo Seiyaku Co., Ltd.) was dissolved in 250 parts of ion exchange water.

A total of 50 parts of ion exchange water in which 2 parts of ammonium persulfate were dissolved was further added while slowly stirring and mixing for 10 min.

Next, the system was sufficiently purged with nitrogen and then heated till the temperature inside the system reached 70° C. with an oil bath under stirring, and emulsion polymerization is continued for 5 h as it is to obtain a resin particle-dispersed solution D-11 (solid fraction concentration: 25.0% by mass).

The volume average particle diameter of the resin particles in the resin particle-dispersed solution D-11 was 0.18 μm, the glass transition temperature (Tg) was 58.0° C., and the weight average molecular weight (Mw) was 35000.

Production Example of Wax-Dispersed Solution W-1

| | |
|---|---|
| Behenyl behenate | 50.0 parts |
| Anionic surfactant (Neogen RK, manufactured by Daiichi Kogyo Seiyaku Co., Ltd.) | 0.3 parts |
| Ion exchange water | 150.0 parts |

The above components were mixed, heated to 95° C., and dispersed using a homogenizer (ULTRA TURRAX T50, manufactured by IKA Corporation). Thereafter, dispersion was carried out with a Manton-Gaulin high-pressure homogenizer (manufactured by Gaulin Co., Ltd.) to prepare a wax-dispersed solution W-1 (solid fraction concentration: 25% by mass) in which wax particles were dispersed. The volume average particle size of the obtained wax particles was 0.22 μm.

Production Example of Magnetic Body 1

A total of 55 L of a 4.0 mol/L sodium hydroxide aqueous solution was mixed and stirred with 50 liters of a ferrous sulfate aqueous solution including 2.0 mol/L of $Fe^{2+}$ to obtain a ferrous salt aqueous solution including a ferrous hydroxide colloid. The aqueous solution was maintained at 85° C., and an oxidation reaction was carried out while blowing in air at 20 L/min to obtain a slurry including core particles.

The obtained slurry was filtered and washed with a filter press, and the core particles were then re-dispersed in water. A total of 0.20% by mass of sodium silicate in terms of silicon per 100 parts of core particles was added to the obtained re-slurry solution, the pH of the slurry solution was adjusted to 6.0, and stirring was performed to obtain magnetic iron oxide particles having a silicon-rich surface.

The obtained slurry solution was filtered with a filter press, washed, and re-slurried with ion exchange water. To this re-slurry solution (solid fraction: 50 parts/L), 500 parts (10% by mass with respect to the magnetic iron oxide) of ion exchange resin SK110 (manufactured by Mitsubishi Chemical Co., Ltd.) was added, and stirring was carried out for 2 h for ion exchange. Thereafter, the ion exchange resin was removed by filtration through a mesh, followed by filtration and washing with a filter press, drying and pulverization to obtain a magnetic body 1 having a number average particle diameter of primary particles of 0.21 μm.

Production Example of Magnetic Bodies 2 and 3

Magnetic bodies 2 and 3 were obtained in the same manner as in the Production Example of Magnetic Body 1 except that the blowing amount of air and the oxidation reaction time were adjusted. Table 4 shows the physical properties of each magnetic body.

TABLE 4

| | Number average particle diameter of primary particles (μm) |
|---|---|
| Magnetic body 1 | 0.21 |
| Magnetic body 2 | 0.30 |
| Magnetic body 3 | 0.15 |

Production Example of Magnetic Body-Dispersed Solution M-1

| | |
|---|---|
| Magnetic body 1 | 25.0 parts |
| Ion exchange water | 75.0 parts |

The above materials were mixed and dispersed for 10 min at 8000 rpm using a homogenizer (ULTRA TURRAX T50, manufactured by IKA Corporation) to obtain a magnetic body-dispersed solution M-1. The volume average particle diameter of the magnetic bodies in the magnetic body-dispersed solution M-1 was 0.23 μm.

Production Example of Magnetic Body-Dispersed Solutions M-2 and M-3

Magnetic body-dispersed solutions M-2 and M3 were produced in the same manner as in the Production Example of Magnetic Body-Dispersed Solution M-1, except that the magnetic body 1 was changed to the magnetic bodies 2 and 3, respectively. The volume average particle diameter of the magnetic bodies in the obtained magnetic body-dispersed solution M-2 was 0.18 μm, and the volume average particle size of the magnetic bodies in the magnetic body-dispersed solution M-3 was 0.35 μm.

Production Example of Magnetic Toner Particles 1

| | |
|---|---|
| Resin particle-dispersed solution D-1 (solid fraction 25.0% by mass) | 150.0 parts |
| Resin particle-dispersed solution D-4 (solid fraction 25.0% by mass) | 45.0 parts |
| Wax-dispersed solution W-1 (solid fraction 25.0% by mass) | 15.0 parts |
| Magnetic body-dispersed solution M-1 (solid fraction 25.0% by mass) | 105.0 parts |

The above materials were loaded into a beaker, adjusted to a total number of parts of water of 250 parts, and then adjusted to a temperature of 30.0° C. Then, the materials were mixed by stirring for 1 min at 5000 rpm by using a homogenizer (ULTRA TURRAX T50, manufactured by IKA Corporation).

Furthermore, 10.0 parts of 2.0% by mass aqueous solution of magnesium sulfate was gradually added as a flocculant.

The raw material-dispersed solution was transferred to a polymerization kettle equipped with a stirrer and a thermometer, and was heated to 50.0° C. with a mantle heater and stirred to promote the growth of aggregated particles.

At a stage after 60 min had elapsed, 200.0 parts of a 5.0% by mass aqueous solution of ethylenediaminetetraacetic acid (EDTA) was added to prepare an aggregated particle-dispersed solution 1.

Subsequently, the aggregated particle-dispersed solution 1 was adjusted to pH 8.0 by using a 0.1 mol/L sodium hydroxide aqueous solution, and then the aggregated particle-dispersed solution 1 was heated to 80.0° C. and allowed to stand for 180 min to coalesce the aggregated particles.

After 180 min, a toner particle-dispersed solution 1 in which toner particles were dispersed was obtained. After cooling at a temperature lowering rate of 300° C./min to a temperature of 40° C. or less, the toner particle-dispersed solution 1 was filtered and washed with ion exchange water, and when the conductivity of the filtrate became 50 mS or less, the cake-shaped toner particles were removed.

Next, the cake-shaped toner particles were loaded into ion exchange water taken in an amount 20 times the mass of the toner particles and stirred by a three-one motor. When the toner particles were sufficiently loosened, re-filtration, washing with flowing water, and solid-liquid separation were performed. The resulting cake-shaped toner particles were pulverized in a sample mill and dried in an oven at 40° C. for 24 h. Further, the obtained powder was pulverized with a sample mill, and additional vacuum drying was performed in an oven at 50° C. for 5 h to obtain magnetic toner particles 1.

Production Example of Magnetic Toner 1

A total of 0.3 parts of sol-gel silica fine particles having a number average particle diameter of primary particles of 115 nm were added to 100 parts of the magnetic toner particles 1, and mixed using an FM mixer (manufactured by Nippon Coke Kogyo Co., Ltd.). Thereafter, 0.9 parts of hydrophobic silica fine particles that were obtained by treating silica fine particles having a number average particle diameter of primary particles of 12 nm with hexamethyldisilazane and then treating with silicone oil and that had a BET specific surface area value of 120 $m^2/g$ after the treatment were added, and mixing was similarly performed using the FM mixer (manufactured by Japan Coke Industry Co., Ltd.) to obtain a magnetic toner 1.

The following results relating to the obtained magnetic toner 1 are shown in Table 6.

Number average particle diameter (Dn), average circularity [referred to as circularity in the table], average brightness at Dn [simply referred to as average brightness in the table], CV2/CV1, number average diameter of domains of crystalline polyester [domain diameter of CPES], storage elastic modulus E'(40) at 40° C. in powder dynamic viscoelasticity measurement [simply denoted by E'(40) in the table], storage elastic modulus E'(85) at 85° C. in powder dynamic viscoelasticity measurement [simply denoted by E'(85) in the table], [E'(40)−E'(85)]×100/E'(40), CV3, and CV4.

Example 1

Image Forming Apparatus

A one-component contact development type LaserJet Pro M12 (manufactured by Hewlett Packard Co.) was used after being modified to 200 mm/sec, which is higher than the original process speed.

Further, the evaluation results are shown in Table 7. The evaluation method and evaluation criteria in each evaluation are presented hereinbelow. In addition, business4200 (manufactured by Xerox Co., Ltd.) with a basis weight of 75 $g/m^2$ was used for the evaluation paper to be used for a test, unless specifically stated otherwise.

I. Evaluation of Initial Image Output in High-Temperature and High-Humidity Environment The apparatus modified as described above was filled with 100 g of the magnetic toner 1, and the following evaluation of initial image output was performed in a high-temperature and high-humidity environment (32.5° C./85.0% RH).

1. Initial Image Density

A single-side printing mode was set, and an image having a 5 mm×5 mm black patch image in a total of 9 places: 3 places on the left side and right side and in the center and 3 places at 30 mm intervals in the longitudinal direction therefrom was outputted with a leading margin of 5 mm and left and right margins of 5 mm.

Then, the density of the solid black patch portion on the first page was measured with a Macbeth reflection densitometer (manufactured by Macbeth Co.), and the average value was taken as the initial image density. The criteria for determining the initial image density were as follows.

Evaluation Criteria

A: 1.45 or more

B: 1.40 or more and less than 1.45

C: 1.35 or more and less than 1.40

D: less than 1.35

2. Solid Image Density Uniformity

A single-side printing mode was set and a full-surface solid image was outputted with a leading margin of 5 mm and left and right margins of 5 mm.

Then, the density of the solid image was measured at 10 points with a Macbeth reflection densitometer (manufactured by Macbeth Co.), the difference between the maximum value and the minimum value of the image density was determined, and evaluation was performed according to the following determination criteria.

Evaluation Criteria

A: less than 0.04

B: 0.04 or more and less than 0.08

C: 0.08 or more and less than 0.12

D: 0.12 or more

3. Double-Sided Image Density Uniformity

A double-sided printing mode was set, and an image having a 5 mm×5 mm black patch image in a total of 9 places: 3 places on the left side and right side and in the center and 3 places at 30 mm intervals in the longitudinal direction therefrom was outputted on both sides (2 pages) with a leading margin of 5 mm and left and right margins of 5 mm.

Then, the density of the solid black patch portion was measured with a Macbeth reflection densitometer (manufactured by Macbeth Co.) for the first page and the second page, and the average value of the image density on the first page and the second page was determined. The difference between the average values of the image density on the 1st page and 2nd page was determined, and evaluation was performed according to the following determination criteria.

Evaluation Criteria

A: less than 0.04

B: 0.04 or more and less than 0.08

C: 0.08 or more and less than 0.12

D: 0.12 or more

4. Halftone Image Density Uniformity

A single-side printing mode was set, and an image having a 5 mm×5 mm halftone patch image with a dot printing percentage of 23% in a total of 9 places: 3 places on the left side and right side and in the center and 3 places at 30 mm intervals in the longitudinal direction therefrom was outputted with a leading margin of 5 mm and left and right margins of 5 mm.

Then, the density of each halftone patch image was measured with a Macbeth reflection densitometer (manufactured by Macbeth Co.), the difference between the maximum value and the minimum value of the image density was determined, and evaluation was performed according to the following determination criteria.

Evaluation Criteria

A: less than 0.05

B: 0.05 or more and less than 0.10

C: 0.10 or more and less than 0.15

D: 0.15 or more

II. Repeated Image Output Evaluation in Double-Sided Continuous Output Mode

Subsequently, the apparatus modified as described above was filled with 100 g of the magnetic toner 1, and durability evaluation was performed in a severe environment in terms of temperature rise inside the apparatus by repeated testing of double-sided printing in a continuous mode in a high-temperature and high-humidity environment (32.5° C./85.0% RH).

Specifically, a total of 2500 prints (5000 pages) were outputted by repeating five cycles of continuously outputting 500 sheets (1000 pages) of a horizontal line image having a printing percentage of 1% in the double-sided printing mode.

1. Difference in Image Density Between Before and after Repeated Use

After the repeated use test in a double-sided continuous output mode, a single-side printing mode was set, and an image having a 5 mm×5 mm solid black patch image in a total of 9 places: 3 places on the left side and right side and in the center and 3 places at 30 mm intervals in the longitudinal direction therefrom was outputted with a leading margin of 5 mm and left and right margins of 5 mm.

Then, the density of the solid black patch portion was measured with a Macbeth reflection densitometer (manufactured by Macbeth Co.), and the average value was taken as the image density after repeated use. Then, the difference in density with the initial image density measured as described above was determined, and the evaluation was performed according to the following determination criteria.

Evaluation Criteria

A: difference in density is less than 0.10

B: difference in density is 0.10 or more and less than 0.15

C: difference in density is 0.15 or more and less than 0.20

D: difference in density is 0.20 or more

2. Fogging after Repeated Use

After the repeated use test in a two-sided continuous output mode, a solid white image was outputted using a paper with a tag attached to a part of the image printing surface for masking.

After peeling off the tag from the solid white image, the reflectance (%) was measured at five points for the part where the tag was attached and the part where the tag was not attached, the average values were determined, the difference between the average values was determined, and the result was taken as the fogging after repeated use. The reflectance was measured using a digital white photometer (TC-6D type, manufactured by Tokyo Denshoku Co., Ltd., using a green filter).

The lower the fogging, the better, and the determination was performed according to the following criteria.

A: fogging after repeated use is less than 1.0%

B: fogging after repeated use is 1.0% or more and less than 1.5%

C: fogging after repeated use is 1.5% or more and less than 2.0%

D: fogging after repeated use is 2.0% or more

3. Image Density Uniformity after Repeated Use

After the repeated use test in a double-sided continuous output mode, a single-side printing mode was set, and an image having a 5 mm×5 mm solid black patch image in a total of 9 places: 3 places on the left side and right side and in the center and 3 places at 30 mm intervals in the longitudinal direction therefrom was outputted with a leading margin of 5 mm and left and right margins of 5 mm.

Then, the density of the solid black patch portion was measured with a Macbeth reflection densitometer (manufactured by Macbeth Co.), the maximum value and the minimum value of the image density measured at nine points were determined, and the difference therebetween was determined. The evaluation was performed according to the following determination criteria.

Evaluation Criteria

A: difference in density is less than 0.05

B: difference in density is 0.05 or more and less than 0.10

C: difference in density is 0.10 or more and less than 0.15

D: difference in density is 0.15 or more

III. Evaluation of Image Output after Storage in High-Temperature and High-Humidity Environment The apparatus modified as described above was filled with 100 g of the magnetic toner 1, the main body and the cartridge were loaded into a high-temperature and high-humidity environment (32.5° C./85.0% RH) and then allowed to stand for 7 days, and the image output after the storage was evaluated.

1. Image Density after Storage

A single-side printing mode was set, and an image having a 5 mm×5 mm solid black patch image in a total of 9 places: 3 places on the left side and right side and in the center and 3 places at 30 mm intervals in the longitudinal direction therefrom was outputted with a leading margin of 5 mm and left and right margins of 5 mm.

Then, the density of the solid black patch portion on the first was measured with a Macbeth reflection densitometer (manufactured by Macbeth Co.), and the average value was taken as the image density after storage. The criteria for determining the image density after storage were as follows.

Evaluation Criteria

A: image density after storage is 1.45 or more

B: image density after storage is 1.40 or more and less than 1.45

C: image density after storage is 1.35 or more and less than 1.40

D: image density after storage is less than 1.35

2. Fogging after Storage

A single-side printing mode was set, and a solid white image was outputted using a paper with a tag attached to a part of the image printing surface for masking.

After peeling off the tag from the solid white image, the reflectance (%) was measured at five points for the part where the tag was attached and the part where the tag was not attached, the average values were determined, the difference between the average values was determined, and the result was taken as the fogging after storage. The reflectance was measured using a digital white photometer (TC-6D type, manufactured by Tokyo Denshoku Co., Ltd., using a green filter).

The lower the fogging, the better, and the determination was performed according to the following criteria.

A: fogging after storage is less than 1.0%

B: fogging after storage is 1.0% or more and less than 1.5%

C: fogging after storage 1.5% or more and less than 2.0%

D: fogging after storage 2.0% or more

IV. Evaluation of Low-Temperature Fixability (Cold Offset)

The evaluation was performed in a low-temperature and low-humidity environment (15.0° C./10% RH), by using the abovementioned image forming apparatus and business 4200 (manufactured by Xerox Co.) having a basis weight of 75 g/m$^2$ as evaluation paper.

The evaluation image was a solid black image, and the set temperature of the fixing unit of the image forming apparatus was adjusted to 175° C. During the evaluation, the fixing device was removed, and the following evaluation was carried out with the fixing device sufficiently cooled using a fan or the like. By sufficiently cooling the fixing device after the evaluation, the temperature of the fixing nip portion which has been raised after the image output is lowered, so that the fixability of the toner can be strictly evaluated with satisfactory reproducibility.

The toner 1 was used to output a solid black image on the above-mentioned paper with a leading margin of 10 mm in the state where the fixing device was sufficiently cooled. At this time, the toner laid-on level on the paper was adjusted to be 0.90 mg/cm$^2$. In the evaluation results of toner 1, a satisfactory solid black image with no speckling was obtained. The determination criteria for the cold offset are described below.

The level of speckling was visually evaluated for the solid black image outputted according to the above-mentioned procedure. The determination criteria for the cold offset were as follows.

A: speckling is completely absent: 0

B: some speckling is seen upon close examination: from 1 to 3

C: speckling is seen, but is not conspicuous: from 4 to 6

D: speckling is conspicuous: 7 or more

V. Evaluation of Low-Temperature Fixability (Paper Adhesion)

The evaluation was performed in a normal-temperature and normal-humidity environment (25.0° C./50% RH), by using the abovementioned image forming apparatus and business 4200 (manufactured by Xerox Co.) having a basis weight of 75 g/m$^2$ as evaluation paper.

In the evaluation, the evaluation image was a halftone image, and the image was outputted by decreasing the set temperature of the fixing unit of the image forming apparatus from 200° C. by 5° C. Then, the fixed image was rubbed ten times with silbon paper under a load of 55 g/cm$^2$, and the temperature at which the density reduction rate of the fixed image after rubbing exceeded 10% was taken as the lower limit fixing temperature.

The low-temperature fixability was evaluated according to the following determination criteria on the basis of the obtained lower limit fixing temperature. The lower the fixing lower limit temperature, the better the low-temperature fixability.

Evaluation Criteria

A: less than 150° C.

B: 150° C. or more and less than 160° C.

C: 160° C. or more and less than 175° C.

D: 175° C. or more

VI. Evaluation of Low-Temperature Fixability (Tape Peel Resistance)

The evaluation was performed in a low-temperature and low-humidity environment (15.0° C./10% RH), by using the abovementioned image forming apparatus and business 4200 (manufactured by Xerox Co.) having a basis weight of 75 g/m$^2$ as evaluation paper.

In the evaluation, an image in which 10-point letters E were arranged at three locations with a 30-mm spacing in the center portion was outputted as an evaluation image with a leading margin of 5 mm at a set temperature of 175° C. Then, a tape (Nichiban polyester tape 5511) was attached to each of the three E-letter portions of the obtained image, and then a load of 55 g/cm$^2$ was applied, and the tape was peeled off.

Then, the tape peel resistance was determined from the state of the three E letters (the degree of letter missing) left on the paper according to the following determination criteria.

Evaluation Criteria

A: missing portions are present in none of E letters

B: missing portion is found in one E letter, no missing portion is present in other E letters C: missing portions are found in two E letters, no missing portion is present in other E letters D: missing portions are found in all E letters Production Example of Magnetic Toner Particles 12

| Pre-aggregation Step | |
|---|---|
| Magnetic body-dispersed solution M-1 (solid fraction 25.0% by mass) | 105.0 parts |

The above material was loaded into a beaker, adjusted to 30.0° C., and then stirred for 1 min at 5000 rpm by using a homogenizer (ULTRA TURRAX T50, manufactured by IKA Corporation). Furthermore, 1.0 part of 2.0% by mass aqueous solution of magnesium sulfate was gradually added as a flocculant, followed by stirring for 1 min.

| Aggregation Step | |
|---|---|
| Resin particle-dispersed solution D-1 (solid fraction 25.0% by mass) | 150.0 parts |
| Resin particle-dispersed solution D-5 (solid fraction 25.0% by mass) | 30.0 parts |
| Wax-dispersed solution W-1 (solid fraction 25.0% by mass) | 15.0 parts |

The above materials were loaded into the above beaker, adjusted to a total number of parts of water of 250 parts, and then mixed by stirring for 1 min at 5000 rpm.

Furthermore, 9.0 parts of 2.0% by mass aqueous solution of magnesium sulfate was gradually added as a flocculant.

The raw material-dispersed solution was transferred to a polymerization kettle equipped with a stirrer and a thermometer, and was heated to 50.0° C. with a mantle heater and stirred to promote the growth of aggregated particles.

After 59 min had elapsed, 200.0 parts of a 5.0% by mass aqueous solution of ethylenediaminetetraacetic acid (EDTA) was added to prepare an aggregated particle-dispersed solution 12.

Subsequently, the aggregated particle-dispersed solution 12 was adjusted to pH 8.0 by using a 0.1 mol/L sodium hydroxide aqueous solution, and then the aggregated particle-dispersed solution 2 was heated to 80.0° C. and allowed to stand for 180 min to coalesce the aggregated particles.

After 180 min had elapsed, the toner particle-dispersed solution 12 in which toner particles were dispersed was obtained. After cooling to a temperature of 40° C. or less at a temperature lowering rate of 300.0° C./min, the toner particle-dispersed solution 12 was filtered and washed with flowing ion exchange water, and when the conductivity of the filtrate became 50 mS or less, the cake-shaped toner particles were removed.

Next, the cake-shaped toner particles were loaded into ion exchange water, which was taken in an amount 20 times the mass of the toner particles, and stirred by a three-one motor. When the toner particles were sufficiently loosened, refiltration, washing with flowing water, and solid-liquid separation were performed. The resulting cake-shaped toner particles were pulverized in a sample mill and dried in an oven at 40° C. for 24 h. Further, the obtained powder was pulverized with a sample mill, and additional vacuum drying was performed in an oven at 50° C. for 5 h to obtain magnetic toner particles 12.

Production Examples of Magnetic Toner Particles 2 to 11, 13 to 29, 31 and 32

Magnetic toner particles 2 to 11, 13 to 29, 31 and 32 were obtained in the same manner as in Production Example of Magnetic Toner Particles 1 except that the conditions were changed to those described in Tables 5-1 and 5-2.

In Production Examples of Magnetic Toner Particles 6 to 11, 23, 28, and 29, a surfactant (NOIGEN TDS-200, Daiichi Kogyo Seiyaku Co., Ltd.) was added in the number of addition parts described in Tables 5-1 and 5-2, and then a flocculant was added.

In Production Examples of Magnetic Toner Particles 12 to 21, 25, 27, 31, and 32, the number of addition parts of the flocculant in the pre-aggregation step and the first aggregation step and the type of magnetic bodies were changed as described in Tables 5-1 and 5-2.

In Production Examples of Magnetic Toner Particles 22 to 24 and 26, after the first aggregation step in which the growth of the aggregated particles at 50.0° C. was promoted, a second aggregation step was carried out in which the particle-dispersed solutions described in Table 5-2 were added and the growth of the aggregated particles was again promoted at 50.0° C. The addition of EDTA and subsequent steps were performed after the second aggregation step.

In Production Examples of Magnetic Toner Particles 11 and 15 to 17, the temperature lowering rate of the toner particle-dispersed solution after the coalescence of the aggregated particles was changed as described in Tables 5-1 and 5-2.

TABLE 5-1

| Toner | Pre-aggregation step | | | | First aggregation step | | | | | | Second aggregation step | | | Coalescence step Temperature |
|---|---|---|---|---|---|---|---|---|---|---|---|---|---|---|
| particle No. | Dispersed solution No. | Parts | Flocculant (parts) | AT | Dispersed solution No. | Parts | Additional surfactant | Parts | Flocculant (parts) | AT | Dispersed solution No. | Parts | AT | lowering rate ° C./min |
| 1 | | | | | D-1 | 150.0 | | | 10.0 | 60 | | | | 300 |
| | | | | | D-4 | 45.0 | | | | | | | | |
| | | | | | W-1 | 15.0 | | | | | | | | |
| | | | | | M-1 | 105.0 | | | | | | | | |
| 2 | | | | | D-1 | 150.0 | | | 10.0 | 60 | | | | 300 |
| | | | | | D-5 | 45.0 | | | | | | | | |
| | | | | | W-1 | 15.0 | | | | | | | | |
| | | | | | M-1 | 105.0 | | | | | | | | |
| 3 | | | | | D-1 | 150.0 | | | 10.0 | 60 | | | | 300 |
| | | | | | D-6 | 35.0 | | | | | | | | |
| | | | | | W-1 | 15.0 | | | | | | | | |
| | | | | | M-1 | 105.0 | | | | | | | | |
| 4 | | | | | D-1 | 150.0 | | | 10.0 | 60 | | | | 300 |
| | | | | | D-7 | 60.0 | | | | | | | | |
| | | | | | W-1 | 15.0 | | | | | | | | |
| | | | | | M-1 | 105.0 | | | | | | | | |
| 5 | | | | | D-1 | 150.0 | | | 10.0 | 60 | | | | 300 |
| | | | | | D-5 | 30.0 | | | | | | | | |
| | | | | | W-1 | 15.0 | | | | | | | | |
| | | | | | M-1 | 105.0 | | | | | | | | |
| 6 | | | | | D-1 | 150.0 | NOIGEN | 0.05 | 10.0 | 60 | | | | 300 |
| | | | | | D-5 | 30.0 | TDS-200D | | | | | | | |
| | | | | | W-1 | 15.0 | | | | | | | | |
| | | | | | M-1 | 105.0 | | | | | | | | |
| 7 | | | | | D-1 | 150.0 | NOIGEN | 0.1 | 10.0 | 60 | | | | 300 |
| | | | | | D-5 | 30.0 | TDS-200D | | | | | | | |
| | | | | | W-1 | 15.0 | | | | | | | | |
| | | | | | M-1 | 105.0 | | | | | | | | |
| 8 | | | | | D-1 | 150.0 | NOIGEN | 0.2 | 10.0 | 60 | | | | 300 |
| | | | | | D-5 | 30.0 | TDS-200D | | | | | | | |
| | | | | | W-1 | 15.0 | | | | | | | | |

TABLE 5-1-continued

| Toner particle No. | Pre-aggregation step Dispersed solution No. | Parts | Flocculant (parts) | AT | First aggregation step Dispersed solution No. | Parts | Additional surfactant | Parts | Flocculant (parts) | AT | Second aggregation step Dispersed solution No. | Parts | AT | Coalescence step Temperature lowering rate ° C./min |
|---|---|---|---|---|---|---|---|---|---|---|---|---|---|---|
| | | | | | M-1 | 105.0 | | | | | | | | |
| 9 | | | | | D-2 | 150.0 | NOIGEN | 0.2 | 10.0 | 60 | | | | 300 |
| | | | | | D-5 | 30.0 | TDS-200D | | | | | | | |
| | | | | | W-1 | 15.0 | | | | | | | | |
| | | | | | M-1 | 105.0 | | | | | | | | |
| 10 | | | | | D-2 | 150.0 | NOIGEN | 0.2 | 10.0 | 60 | | | | 300 |
| | | | | | D-5 | 17.5 | TDS-200D | | | | | | | |
| | | | | | W-1 | 15.0 | | | | | | | | |
| | | | | | M-1 | 105.0 | | | | | | | | |
| 11 | | | | | D-2 | 150.0 | NOIGEN | 0.2 | 10.0 | 60 | | | | 1 |
| | | | | | D-5 | 17.5 | TDS-200D | | | | | | | |
| | | | | | W-1 | 15.0 | | | | | | | | |
| | | | | | M-1 | 105.0 | | | | | | | | |
| 12 | | | 1.0 | 1 | D-1 | 150.0 | | | 9.0 | 59 | | | | 300 |
| | | | | | D-5 | 30.0 | | | | | | | | |
| | | | | | W-1 | 15.0 | | | | | | | | |
| | M-1 | 105.0 | | | | | | | | | | | | |
| 13 | | | 1.5 | 1 | D-1 | 150.0 | | | 8.5 | 59 | | | | 300 |
| | | | | | D-5 | 30.0 | | | | | | | | |
| | | | | | W-1 | 15.0 | | | | | | | | |
| | M-1 | 105.0 | | | | | | | | | | | | |
| 14 | | | 2.0 | 1 | D-1 | 150.0 | | | 8.0 | 59 | | | | 300 |
| | | | | | D-5 | 30.0 | | | | | | | | |
| | | | | | W-1 | 15.0 | | | | | | | | |
| | M-1 | 105.0 | | | | | | | | | | | | |
| 15 | | | 2.0 | 1 | D-1 | 150.0 | | | 8.0 | 59 | | | | 1 |
| | | | | | D-5 | 30.0 | | | | | | | | |
| | | | | | W-1 | 15.0 | | | | | | | | |
| | M-1 | 105.0 | | | | | | | | | | | | |
| 16 | | | 1.0 | 1 | D-1 | 150.0 | | | 9.0 | 59 | | | | 1 |
| | | | | | D-8 | 30.0 | | | | | | | | |
| | | | | | W-1 | 15.0 | | | | | | | | |
| | M-1 | 105.0 | | | | | | | | | | | | |

In the Table 5-1 and 5-2, "AT" denotes aggregation time (min).

TABLE 5-2

| Toner particle No. | Pre-aggregation step Dispersed solution No. | Parts | Flocculant (parts) | AT | First aggregation step Dispersed solution No. | Parts | Additional surfactant | Parts | Flocculant (parts) | AT | Second aggregation step Dispersed solution No. | Parts | AT | Coalescence step Temperature lowering rate ° C./min |
|---|---|---|---|---|---|---|---|---|---|---|---|---|---|---|
| 17 | | | 1.0 | 1 | D-1 | 150.0 | | | 9.0 | 59 | | | | 1 |
| | | | | | D-9 | 30.0 | | | | | | | | |
| | | | | | W-1 | 15.0 | | | | | | | | |
| | M-1 | 105.0 | | | | | | | | | | | | |
| 18 | | | 2.0 | 1 | D-1 | 150.0 | | | 8.0 | 59 | | | | 300 |
| | | | | | D-5 | 17.5 | | | | | | | | |
| | | | | | W-1 | 15.0 | | | | | | | | |
| | M-1 | 105.0 | | | | | | | | | | | | |
| 19 | | | 2.0 | 1 | D-3 | 150.0 | | | 8.0 | 59 | | | | 300 |
| | | | | | D-5 | 30.0 | | | | | | | | |
| | | | | | W-1 | 15.0 | | | | | | | | |
| | M-1 | 105.0 | | | | | | | | | | | | |
| 20 | | | 2.0 | 1 | D-3 | 150.0 | | | 8.0 | 59 | | | | 300 |
| | | | | | D-5 | 10.0 | | | | | | | | |
| | | | | | W-1 | 15.0 | | | | | | | | |
| | M-1 | 105.0 | | | | | | | | | | | | |
| 21 | | | 2.0 | 1 | D-3 | 150.0 | | | 8.0 | 59 | | | | 300 |
| | | | | | D-10 | 30.0 | | | | | | | | |
| | | | | | W-1 | 15.0 | | | | | | | | |
| | M-1 | 105.0 | | | | | | | | | | | | |
| 22 | | | | | D-1 | 150.0 | | | 10.0 | 20 | | | 40 | 300 |
| | | | | | D-6 | 35.0 | | | | | | | | |
| | | | | | | | | | | | W-1 | 15.0 | | |
| | | | | | M-1 | 105.0 | | | | | | | | |

TABLE 5-2-continued

| Toner particle No. | Pre-aggregation step Dispersed solution No. | Parts | Flocculant (parts) | AT | First aggregation step Dispersed solution No. | Parts | Additional surfactant | Parts | Flocculant (parts) | AT | Second aggregation step Dispersed solution No. | Parts | AT | Coalescence step Temperature lowering rate ° C./min |
|---|---|---|---|---|---|---|---|---|---|---|---|---|---|---|
| 23 | | | | | D-1 | 150.0 | NOIGEN | 0.2 | 10.0 | 20 | | | 40 | 300 |
| | | | | | D-6 | 35.0 | TDS-200D | | | | | | | |
| | | | | | | | | | | | W-1 | 15.0 | | |
| | | | | | M-2 | 105.0 | | | | | | | | |
| 24 | | | | | D-1 | 150.0 | | | 10.0 | 20 | | | 40 | 300 |
| | | | | | D-6 | 32.0 | | | | | | | | |
| | | | | | W-1 | 15.0 | | | | | | | | |
| | | | | | | | | | | | M-1 | 75.0 | | |
| 25 | | | 1.0 | 1 | D-1 | 150.0 | | | 9.0 | 59 | | | | 300 |
| | | | | | D-6 | 40.0 | | | | | | | | |
| | | | | | W-1 | 15.0 | | | | | | | | |
| | M-3 | 130.0 | | | | | | | | | | | | |
| 26 | | | | | D-1 | 150.0 | | | 10.0 | 20 | | | 40 | 300 |
| | | | | | D-6 | 30.0 | | | | | | | | |
| | | | | | W-1 | 15.0 | | | | | | | | |
| | | | | | | | | | | | M-1 | 60.0 | | |
| 27 | | | 1.0 | 1 | D-1 | 150.0 | | | 9.0 | 59 | | | | 300 |
| | | | | | D-6 | 42.0 | | | | | | | | |
| | | | | | W-1 | 15.0 | | | | | | | | |
| | M-3 | 150.0 | | | | | | | | | | | | |
| 28 | | | | | D-2 | 150.0 | NOIGEN | 0.2 | 10.0 | 60 | | | | 300 |
| | | | | | D-5 | 6.0 | TDS-200D | | | | | | | |
| | | | | | W-1 | 15.0 | | | | | | | | |
| | | | | | M-1 | 105.0 | | | | | | | | |
| 29 | | | | | D-11 | 150.0 | NOIGEN | 0.2 | 10.0 | 60 | | | | 300 |
| | | | | | D-5 | 17.5 | TDS-200D | | | | | | | |
| | | | | | W-1 | 15.0 | | | | | | | | |
| | | | | | M-1 | 105.0 | | | | | | | | |
| 31 | | | 3.0 | 1 | D-1 | 150.0 | | | 7.0 | 59 | | | | 300 |
| | | | | | D-5 | 30.0 | | | | | | | | |
| | | | | | W-1 | 15.0 | | | | | | | | |
| | M-1 | 105.0 | | | | | | | | | | | | |
| 32 | | | 2.0 | 1 | D-3 | 150.0 | | | 8.0 | 59 | | | | 300 |
| | | | | | D-5 | 6.0 | | | | | | | | |
| | | | | | W-1 | 15.0 | | | | | | | | |
| | M-1 | 105.0 | | | | | | | | | | | | |

Production Example of Magnetic Toner Particles 30

| | |
|---|---|
| Resin particle-dispersed solution D-1 (solid fraction 25.0% by mass) | 150.0 parts |
| Resin particle-dispersed solution D-5 (solid fraction 25.0% by mass) | 30.0 parts |
| Wax-dispersed solution W-2 (solid fraction 25.0% by mass) | 15.0 parts |
| Magnetic body-dispersed solution M-1 (solid fraction 25.0% by mass) | 105.0 parts |

The above materials were loaded into a beaker, adjusted to a total number of parts of water of 250 parts, and then adjusted to 30.0° C. Then, the materials were mixed by stirring for 10 min at 8000 rpm using a homogenizer (ULTRA TURRAX T50, manufactured by IKA Corporation).

Furthermore, 10.0 parts of 2.0% by mass aqueous solution of aluminum chloride was gradually added as a flocculant.

The raw material-dispersed solution was transferred to a polymerization kettle equipped with a stirrer and a thermometer, and was heated to 50.0° C. with a mantle heater and stirred to promote the growth of aggregated particles.

After 60 min had elapsed, the pH was adjusted to 5.4 by using a 0.1 mol/L sodium hydroxide aqueous solution, and then the aggregated particle-dispersed solution 30 was heated to 96.0° C. and allowed to stand for 180 min to coalesce the aggregated particles.

After 180 min had elapsed, the toner particle-dispersed solution 30 in which toner particles were dispersed was obtained. After cooling at a temperature lowering rate of 1.0° C./min, the toner particle-dispersed solution 30 was filtered and washed with ion exchange water, and when the conductivity of the filtrate became 50 mS or less, the cake-shaped toner particles were removed.

Next, the cake-shaped toner particles were loaded into ion exchange water, which was taken in an amount 20 times the mass of the toner particles, and stirred by a three-one motor. When the toner particles were sufficiently loosened, refiltration, washing with flowing water, and solid-liquid separation were performed. The resulting cake-shaped toner particles were pulverized in a sample mill and dried in an oven at 40° C. for 24 h. Further, the obtained powder was pulverized with a sample mill, and additional vacuum drying was performed in an oven at 40° C. for 5 h to obtain magnetic toner particles 30.

Production Example of Magnetic Toner Particles 33

| | |
|---|---|
| Polyester A1 | 100.0 parts |
| Magnetic bodies 1 | 70.0 parts |
| Release agent: Fischer-Tropsch wax (manufactured by Sasol Limited, C 105, melting point 105° C.) | 4.0 parts |

-continued

| | |
|---|---|
| Charge control agent (T-77: Hodogaya Chemical Co., Ltd.) | 2.0 parts |

The above materials were premixed with an FM mixer (manufactured by Nippon Coke & Engineering Co., Ltd.), and then melt-kneaded with a twin-screw kneading extruder (Model PCM-30, manufactured by Ikegai Iron Works Co., Ltd.).

The obtained kneaded product was cooled, roughly pulverized with a hammer mill, and then pulverized with a mechanical pulverizer (T-250, manufactured by Turbo Kogyo Co., Ltd.). The obtained finely pulverized powder was classified with a multi-fraction division classifier using the Coanda effect to obtain negatively charged magnetic toner particles 33 with a Dn (μm) of 6.9 μm. The Tg of the toner particles 33 was 60.0° C.

Production Example of Magnetic Toner Particles 34

| | |
|---|---|
| Polyester A1 | 100.0 parts |
| Crystalline polyester B2 | 4.0 parts |
| Magnetic bodies 1 | 70.0 parts |
| Release agent: Fischer-Tropsch wax (manufactured by Sasol Limited, C 105, melting point 105° C.) | 4.0 parts |
| Charge control agent (T-77: Hodogaya Chemical Co., Ltd.) | 2.0 parts |

The above materials were premixed with an FM mixer (manufactured by Nippon Coke & Engineering Co., Ltd.), and then melt-kneaded with a twin-screw kneading extruder (Model PCM-30, manufactured by Ikegai Iron Works Co., Ltd.).

The obtained kneaded product was cooled, roughly pulverized with a hammer mill, and then pulverized with a mechanical pulverizer (T-250, manufactured by Turbo Kogyo Co., Ltd.). The obtained finely pulverized powder was classified with a multi-fraction division classifier using the Coanda effect to obtain negatively charged magnetic toner particles 34 with a Dn (μm) of 6.8 μm. The Tg of the toner particles 34 was 55.1° C.

Production Examples of Magnetic Toners 2 to 34

Magnetic toners 2 to 34 were obtained in the same manner as in Production Example of Magnetic Toner 1 except that the magnetic toner particles 1 were changed to magnetic toner particles 2 to 34.

The following results relating to the obtained magnetic toners 2 to 34 are shown in Table 6.

Number average particle diameter (Dn), average circularity [referred to as circularity in the table], average brightness at Dn [simply referred to as average brightness in the table], CV2/CV1, number average diameter of domains of crystalline polyester [domain diameter of CPES], storage elastic modulus E'(40) at 40° C. in powder dynamic viscoelasticity measurement [simply denoted by E'(40) in the table], storage elastic modulus E'(85) at 85° C. in powder dynamic viscoelasticity measurement [simply denoted by E'(85) in the table], [E'(40)−E'(85)]×100/E'(40), CV3, and CV4.

TABLE 6

| | Toner No. | Dn (μm) | Circularity | E'(40) × $10^9$ (Pa) | E'(85) × $10^9$ (Pa) | [E'(40) − E'(85) × 100/E'(40) | domain diameter of CPES (nm) | CV2/CV1 | CV3 | Average brightness | CV4 |
|---|---|---|---|---|---|---|---|---|---|---|---|
| Example | 1 | 6.6 | 0.976 | 7.2 | 2.6 | 63.9 | 51 | 0.93 | 61.0 | 41.0 | 58.0 |
| | 2 | 6.5 | 0.980 | 6.7 | 3.3 | 50.7 | 52 | 0.92 | 59.0 | 43.0 | 66.0 |
| | 3 | 6.7 | 0.977 | 7.1 | 3.1 | 56.3 | 80 | 0.93 | 59.0 | 42.0 | 57.0 |
| | 4 | 6.8 | 0.977 | 6.8 | 2.1 | 69.1 | 62 | 0.90 | 57.0 | 40.0 | 50.0 |
| | 5 | 6.6 | 0.980 | 6.9 | 3.6 | 47.8 | 81 | 0.87 | 55.0 | 41.5 | 51.0 |
| | 6 | 6.5 | 0.975 | 6.6 | 3.4 | 48.5 | 82 | 0.90 | 50.0 | 48.1 | 43.0 |
| | 7 | 6.7 | 0.972 | 6.5 | 3.5 | 46.2 | 84 | 0.90 | 46.0 | 43.0 | 40.0 |
| | 8 | 6.4 | 0.974 | 6.4 | 3.4 | 46.9 | 65 | 0.90 | 41.0 | 43.0 | 35.0 |
| | 9 | 6.7 | 0.979 | 6.1 | 3.3 | 45.9 | 110 | 0.88 | 41.0 | 43.0 | 35.0 |
| | 10 | 6.4 | 0.976 | 6.2 | 3.6 | 41.9 | 115 | 0.88 | 41.0 | 43.0 | 33.0 |
| | 11 | 6.2 | 0.981 | 6.0 | 3.6 | 40.0 | 280 | 0.90 | 41.0 | 43.0 | 28.0 |
| | 12 | 6.8 | 0.971 | 7.0 | 3.6 | 48.6 | 88 | 0.85 | 78.0 | 43.0 | 67.0 |
| | 13 | 6.5 | 0.973 | 6.8 | 3.5 | 48.5 | 90 | 0.88 | 85.0 | 43.0 | 83.0 |
| | 14 | 6.4 | 0.972 | 6.7 | 3.4 | 49.3 | 120 | 0.88 | 88.0 | 43.0 | 87.0 |
| | 15 | 6.2 | 0.970 | 6.7 | 3.6 | 46.3 | 330 | 0.88 | 88.0 | 43.0 | 92.0 |
| | 16 | 6.5 | 0.973 | 6.7 | 3.4 | 49.3 | 480 | 0.88 | 78.0 | 43.0 | 95.0 |
| | 17 | 6.7 | 0.973 | 6.7 | 3.6 | 46.3 | 550 | 0.88 | 78.0 | 43.0 | 94.0 |
| | 18 | 6.2 | 0.974 | 6.7 | 3.8 | 43.3 | 99 | 0.88 | 87.1 | 43.0 | 80.0 |
| | 19 | 6.1 | 0.978 | 7.7 | 4.4 | 42.9 | 125 | 0.88 | 88.4 | 43.0 | 81.0 |
| | 20 | 6.6 | 0.976 | 8.6 | 5.1 | 40.7 | 120 | 0.88 | 87.2 | 43.0 | 83.0 |
| | 21 | 7.1 | 0.975 | 8.7 | 5.2 | 40.2 | 250 | 0.88 | 88.6 | 43.0 | 79.0 |
| | 22 | 6.9 | 0.979 | 6.8 | 3.1 | 54.4 | 180 | 0.98 | 59.0 | 49.0 | 57.0 |
| | 23 | 6.2 | 0.972 | 6.9 | 3.1 | 55.1 | 190 | 1.08 | 55.0 | 36.0 | 50.0 |
| | 24 | 6.8 | 0.976 | 6.8 | 3.1 | 54.4 | 200 | 0.84 | 74.0 | 56.1 | 71.0 |
| | 25 | 6.9 | 0.973 | 6.9 | 3.1 | 55.1 | 200 | 0.87 | 52.0 | 32.1 | 48.0 |
| | 26 | 6.8 | 0.976 | 6.8 | 3.1 | 54.4 | 190 | 0.91 | 75.0 | 61.1 | 71.0 |
| | 27 | 6.5 | 0.977 | 6.9 | 3.1 | 55.1 | 200 | 0.85 | 50.0 | 28.7 | 53.0 |
| C. E. | 28 | 6.7 | 0.976 | 6.3 | 4.5 | 28.6 | 200 | 0.88 | 42.0 | 43.0 | 32.0 |
| | 29 | 6.8 | 0.976 | 5.5 | 3.9 | 29.1 | 220 | 0.87 | 41.0 | 43.0 | 28.0 |
| | 30 | 6.7 | 0.980 | 5.7 | 3.4 | 40.4 | 230 | 0.90 | 28.5 | 43.0 | 22.0 |
| | 31 | 6.9 | 0.978 | 5.5 | 3.3 | 40.0 | 180 | 0.97 | 92.0 | 45.8 | 98.0 |

TABLE 6-continued

| Toner No. | Dn (μm) | Circularity | E'(40) × $10^9$ (Pa) | E'(85) × $10^9$ (Pa) | [E'(40) − E'(85) × 100/E'(40) | domain diameter of CPES (nm) | CV2/CV1 | CV3 | Average brightness | CV4 |
|---|---|---|---|---|---|---|---|---|---|---|
| 32 | 6.5 | 0.976 | 8.6 | 5.6 | 34.9 | 200 | 0.88 | 88.0 | 43.0 | 78.0 |
| 33 | 6.9 | 0.939 | 6.6 | 5.1 | 22.7 | | 0.88 | 25.0 | 43.0 | |
| 34 | 6.9 | 0.938 | 5.8 | 4.1 | 29.3 | 20 | 0.91 | 24.3 | 43.0 | 21.0 |

In the table, C.E. denotes comparative example.

Examples 2 to 27 and Comparative Examples 1 to 7

The same evaluation as in Example 1 was performed using magnetic toners 2 to 34. The results are shown in Table 7.

TABLE 7

| | Toner No. | Difference in image density between before and after repeated use | | Low-temperature fixability: cold offset | | Low-temperature fixability: paper adhesion | | Solid image uniformity | | Fogging after repeated use | | Initial image density | | Double-sided density uniformity | | Halftone density uniformity | | LFT | Density uniformity after repeated use | | Fogging after storage | | Image density after storage | |
|---|---|---|---|---|---|---|---|---|---|---|---|---|---|---|---|---|---|---|---|---|---|---|---|---|
| Example | 1 | A | 0.02 | A | 0 | A | 140 | A | 0.01 | A | 0.1 | A | 1.55 | A | 0.02 | A | 0.02 | A | A | 0.02 | A | 0.3 | A | 1.53 |
| | 2 | A | 0.03 | A | 0 | A | 140 | A | 0.02 | A | 0.2 | A | 1.53 | A | 0.03 | A | 0.03 | A | A | 0.02 | A | 0.3 | A | 1.52 |
| | 3 | A | 0.03 | A | 0 | A | 140 | A | 0.02 | A | 0.3 | A | 1.52 | A | 0.03 | A | 0.03 | A | A | 0.02 | A | 0.3 | A | 1.51 |
| | 4 | A | 0.04 | A | 0 | A | 140 | A | 0.02 | A | 0.2 | A | 1.51 | A | 0.03 | A | 0.03 | A | A | 0.02 | A | 0.3 | A | 1.50 |
| | 5 | A | 0.05 | B | 1 | A | 140 | A | 0.03 | A | 0.2 | A | 1.51 | A | 0.03 | A | 0.03 | A | A | 0.03 | A | 0.3 | A | 1.50 |
| | 6 | B | 0.10 | B | 1 | A | 140 | A | 0.03 | A | 0.2 | A | 1.51 | A | 0.03 | A | 0.03 | A | A | 0.03 | A | 0.3 | A | 1.50 |
| | 7 | B | 0.11 | B | 1 | A | 140 | A | 0.03 | B | 1.1 | A | 1.51 | A | 0.03 | A | 0.03 | A | A | 0.03 | A | 0.3 | A | 1.49 |
| | 8 | B | 0.11 | B | 1 | A | 140 | A | 0.03 | C | 1.5 | A | 1.51 | A | 0.03 | A | 0.03 | A | A | 0.03 | A | 0.3 | A | 1.49 |
| | 9 | C | 0.15 | B | 1 | A | 140 | B | 0.04 | C | 1.5 | A | 1.51 | A | 0.03 | A | 0.03 | A | A | 0.03 | A | 0.3 | A | 1.49 |
| | 10 | C | 0.16 | C | 4 | A | 140 | B | 0.05 | C | 1.5 | A | 1.51 | A | 0.03 | A | 0.03 | B | A | 0.03 | A | 0.3 | A | 1.49 |
| | 11 | C | 0.17 | C | 4 | A | 140 | B | 0.05 | C | 1.5 | A | 1.51 | A | 0.03 | A | 0.04 | C | A | 0.03 | A | 0.3 | A | 1.49 |
| | 12 | A | 0.05 | B | 2 | A | 140 | A | 0.03 | A | 0.4 | A | 1.51 | A | 0.03 | A | 0.04 | A | A | 0.03 | A | 0.3 | A | 1.49 |
| | 13 | A | 0.06 | B | 2 | A | 140 | A | 0.03 | A | 0.5 | B | 1.44 | A | 0.03 | A | 0.04 | A | A | 0.03 | A | 0.3 | B | 1.43 |
| | 14 | A | 0.06 | B | 2 | A | 140 | A | 0.03 | A | 0.6 | C | 1.39 | A | 0.03 | A | 0.04 | B | A | 0.03 | A | 0.3 | C | 1.38 |
| | 15 | A | 0.06 | B | 2 | A | 140 | A | 0.03 | A | 0.5 | C | 1.39 | A | 0.03 | A | 0.04 | C | A | 0.03 | A | 0.3 | C | 1.38 |
| | 16 | A | 0.07 | B | 2 | A | 140 | A | 0.03 | A | 0.4 | A | 1.46 | B | 0.05 | A | 0.04 | C | A | 0.03 | A | 0.3 | A | 1.45 |
| | 17 | A | 0.07 | B | 3 | A | 140 | A | 0.03 | A | 0.5 | A | 1.46 | C | 0.08 | A | 0.04 | C | A | 0.03 | A | 0.3 | A | 1.45 |
| | 18 | A | 0.07 | B | 3 | A | 140 | A | 0.03 | A | 0.5 | C | 1.37 | A | 0.03 | A | 0.04 | A | A | 0.03 | A | 0.3 | C | 1.36 |
| | 19 | A | 0.04 | C | 5 | B | 150 | A | 0.03 | A | 0.5 | C | 1.37 | A | 0.03 | A | 0.04 | A | A | 0.03 | A | 0.3 | C | 1.36 |
| | 20 | A | 0.03 | C | 5 | C | 160 | A | 0.03 | A | 0.5 | C | 1.37 | A | 0.03 | A | 0.04 | A | A | 0.03 | A | 0.3 | C | 1.36 |
| | 21 | A | 0.06 | C | 5 | C | 160 | A | 0.03 | A | 0.5 | C | 1.37 | A | 0.03 | C | 0.11 | A | A | 0.03 | A | 0.3 | C | 1.36 |
| | 22 | A | 0.08 | A | 0 | A | 140 | A | 0.03 | A | 0.5 | A | 1.47 | A | 0.03 | A | 0.04 | A | B | 0.08 | A | 0.6 | A | 1.45 |
| | 23 | A | 0.08 | A | 0 | A | 140 | A | 0.03 | A | 0.5 | A | 1.46 | A | 0.03 | A | 0.04 | A | C | 0.12 | A | 0.6 | A | 1.45 |
| | 24 | A | 0.08 | A | 0 | A | 140 | A | 0.03 | A | 0.5 | A | 1.45 | A | 0.03 | A | 0.04 | A | A | 0.04 | A | 0.8 | B | 1.40 |
| | 25 | A | 0.08 | A | 0 | A | 140 | A | 0.03 | A | 0.5 | A | 1.45 | A | 0.03 | A | 0.04 | A | A | 0.04 | B | 1.0 | A | 1.45 |
| | 26 | A | 0.08 | A | 0 | A | 140 | A | 0.03 | A | 0.5 | A | 1.45 | A | 0.03 | A | 0.04 | A | A | 0.04 | A | 0.9 | C | 1.35 |
| | 27 | A | 0.08 | A | 0 | A | 140 | A | 0.03 | A | 0.6 | A | 1.45 | A | 0.03 | A | 0.04 | A | A | 0.04 | C | 1.5 | A | 1.45 |
| C. E. | 28 | C | 0.18 | D | 13 | B | 155 | B | 0.07 | C | 1.9 | B | 1.40 | B | 0.06 | B | 0.09 | B | B | 0.09 | B | 1.4 | B | 1.40 |
| | 29 | D | 0.26 | D | 12 | B | 155 | D | 0.14 | C | 1.9 | B | 1.40 | B | 0.06 | A | 0.04 | C | B | 0.09 | B | 1.3 | B | 1.41 |
| | 30 | D | 0.22 | C | 5 | B | 155 | B | 0.07 | D | 2.5 | B | 1.40 | B | 0.06 | A | 0.04 | C | B | 0.09 | B | 1.4 | B | 1.40 |
| | 31 | D | 0.28 | C | 5 | B | 155 | B | 0.07 | B | 1.4 | D | 1.30 | B | 0.06 | A | 0.04 | C | C | 0.14 | B | 1.4 | D | 1.25 |
| | 32 | A | 0.09 | D | 9 | D | 185 | B | 0.07 | B | 1.4 | C | 1.35 | B | 0.06 | C | 0.14 | B | B | 0.08 | B | 1.4 | D | 1.30 |
| | 33 | B | 0.14 | D | 15 | C | 170 | B | 0.07 | D | 2.3 | B | 1.41 | C | 0.09 | D | 0.17 | D | B | 0.08 | B | 1.3 | B | 1.40 |
| | 34 | D | 0.29 | D | 13 | C | 165 | B | 0.07 | D | 2.8 | B | 1.40 | D | 0.13 | C | 0.13 | C | B | 0.09 | B | 1.4 | B | 1.40 |

In the table, C.E. denotes "comparative example", and LFT denotes "Low-temperature fixability (tape peel resistance)".

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-187627, filed Oct. 2, 2018, which is hereby incorporated by reference herein in its entirety.

What is claimed is:

1. A magnetic toner, comprising:

a magnetic toner particle including a binder resin, a magnetic body and a crystalline polyester, wherein $E'(40) \geq 6.0 \times 10^9$, $E'(85) \leq 5.5 \times 10^9$, and $[E'(40)-E'(85)] \times 100/E'(40) \geq 40$ where E'(40) [Pa] is a storage elastic modulus at 40° C. and E'(85) [Pa] is a storage elastic modulus at 85° C., which are obtained in a powder dynamic viscoelasticity measurement of the magnetic toner.

2. The magnetic toner according to claim 1, wherein the binder resin comprises an amorphous polyester including a monomer unit derived from an aromatic diol and/or a monomer unit derived from an aromatic dicarboxylic acid.

3. The magnetic toner according to claim 2, wherein a content ratio of the monomer unit derived from an aromatic diol and the monomer unit derived from an aromatic dicarboxylic acid is 85 mol % or more based on the total monomer units constituting the amorphous polyester.

4. The magnetic toner according to claim 1, wherein a variation coefficient CV3 of an occupied area ratio of the magnetic bodies is 40.0 to 90.0% when a cross section of the magnetic toner particle is divided by a square grid having a side of 0.8 μm is observed using a transmission electron microscope.

5. The magnetic toner according to claim 1, wherein domains of the crystalline polyester having a number average diameter of 50 to 500 nm are observed in a cross section of the magnetic toner particle using a transmission electron microscope.

6. The magnetic toner according to claim 1, wherein a variation coefficient CV4 of an occupied area ratio of the crystalline polyester is 30.0 to 90.0% when a cross section of the magnetic toner particle is divided by a square grid having a side of 0.8 μm is observed using a transmission electron microscope.

7. The magnetic toner according to claim 1, wherein the crystalline polyester comprises a monomer unit derived from an aliphatic diol having 2 to 12 carbon atoms, and/or a monomer unit derived from an aliphatic dicarboxylic acid having 2 to 12 carbon atoms.

8. The magnetic toner according to claim 1, wherein $E'(85) \leq 5.0 \times 10^9$.

9. The magnetic toner according to claim 1, wherein $CV2/CV1 \leq 1.00$ when Dn (μm) is a number average particle diameter of the magnetic toner, CV1 (%) is a variation coefficient of a brightness dispersion value of the magnetic toner in a range from Dn−0.500 to Dn+0.500, and CV2 (%) is a variation coefficient of a brightness dispersion value of the magnetic toner in a range from Dn−1.500 to Dn−0.500, and 60.0.

* * * * *